US006152626A

United States Patent [19]

Yanagi et al.

[11] Patent Number: 6,152,626

[45] **Date of Patent: *Nov. 28, 2000**

[54] RECORDING APPARATUS AND RECORDING METHOD

[75] Inventors: Haruyuki Yanagi, Machida; Makoto Kawarama, Kawasaki; Masaya Shinmachi, Kawasaki; Tan At Ming, Kawasaki, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/678,744

[22] Filed: Jul. 11, 1996

[30] Foreign Application Priority Data

| | | | |
|---|---|---|---|
| Jul. 14, 1995 | [JP] | Japan | 7-179087 |
| Aug. 9, 1995 | [JP] | Japan | 7-203133 |
| Oct. 25, 1995 | [JP] | Japan | 7-300553 |
| Oct. 25, 1995 | [JP] | Japan | 7-300554 |

[51] Int. Cl.[7] ..... B41J 21/16

[52] U.S. Cl. ..... 400/279; 400/315; 400/705.1

[58] Field of Search ..... 400/315, 320, 400/322, 705, 705.1, 279, 283

[56] References Cited

U.S. PATENT DOCUMENTS

| | | | |
|---|---|---|---|
| 5,151,716 | 9/1992 | Kanemitsu . | |
| 5,255,987 | 10/1993 | Mizuno et al. | 400/705 |
| 5,299,873 | 4/1994 | Miebori | 400/279 |
| 5,668,580 | 9/1997 | Chan et al. | 400/705 |

FOREIGN PATENT DOCUMENTS

| | | |
|---|---|---|
| 0442713 | 8/1991 | European Pat. Off. . |
| 0607871 | 7/1994 | European Pat. Off. . |
| 4314904 | 9/1994 | Germany . |
| 2-88277 | 3/1990 | Japan . |

*Primary Examiner*—Ren Yan

*Attorney, Agent, or Firm*—Fitzpatrick, Cella, Harper & Scinto

[57] ABSTRACT

A recording apparatus comprises a recording head for forming an image on a recording medium, a carriage for holding the recording head, capable of scanning in a main scanning direction, and a carrying mechanism for carrying the recording medium in a sub-scanning direction, wherein even with shift of the position of the carriage before scanning, scanning of the carriage is carried out after the carriage is located at a start position, or wherein a difference of the start position of the carriage upon each scanning is arranged to be a distance equal to an integral multiple of one period of phase of motor.

10 Claims, 20 Drawing Sheets

| SCAN | PRINTING IMAGE | END OF PRINT AREA | START POSITION |
|---|---|---|---|
| 1 | 1ST LINE OF Y | E1 | S1 |
| 2 | 2ND LINE OF Y, 1ST LINE OF M | E1 | S1 |
| 3 | 3RD LINE OF Y, 2ND LINE OF M, 1ST LINE OF C | E1 | S1 |
| 4 | 4TH LINE OF Y, 3RD LINE OF M, 2ND LINE OF C | E2 | S2 |
| 5 | 4TH LINE OF M, 3RD LINE OF C | E3 | S2 |
| 6 | 4TH LINE OF C | E4 | S2 |

RECORDING APPARATUS AND RECORDING METHOD

BACKGROUND OF THE INVENTION

1. Field of the Invention

The present invention relates to a serial recording apparatus and a recording method thereof for forming an image as moving a carriage mounted with a recording head.

2. Related Background Art

The print apparatus having the functions of printer, copier, facsimile machine, and so on, or the print apparatus used as an output device of composite electronic equipment including computers, word processors, and so on or workstation, is arranged to print an image on a printed medium such as paper or a plastic thin film, based on image information. Such print apparatus can be classified by their print method, for example, under the ink jet method, the wire dot method, the thermal method, the laser beam method, and so on.

In the print apparatus of the serial type adopting the serial scan method for primarily scanning the printed medium in directions intersecting the sheet carrying direction (the secondary scanning or sub-scan direction), the image is printed (or primarily scanned) by a print means mounted on the carriage moving along the printed medium, a predetermined amount of sheet feed (pitch carry) is carried out after completion of print of one line, thereafter the printed medium, again stopped, is subjected to printing (primary scanning) of a next line image, and this operation is repeated to effect recording on the entire printed medium. In the case of the print apparatus of a line type for recording the image only by secondarily scanning the printed medium in the carrying direction thereof, the printed medium is set at a predetermined print position, then a full line is printed together, then a predetermined amount of sheet feed (pitch feed) is carried out, a next line is printed together, and this operation is repeated to complete printing on the entire printed medium.

In order to eliminate band stripes in the width (of one line) of the print head, appearing upon scanning, the conventional print apparatus of the above serial type employs the fine print method in which the line feed pitch is set to the half to the quarter of the width of the print head, the dots forming the image are thinned out every scanning, and the dots are formed by a plurality of scanning steps of the carriage per line, thereby eliminating the band stripes.

In the above fine print method, however, forming positions of such adjacent dots are easy to deviate so as to become prominent in the image, because the adjacent dots are formed by plural scanning steps of carriage. It is thus necessary to secure the accuracy of dot forming positions in the plural scanning steps of carriage. It is, however, difficult to secure the accuracy of such dot forming positions, especially, when the carriage moves for cleaning of the recording head or the like, so as to change the start position of the carriage upon scanning. In addition to the problem upon the fine print, the problem of ruled line deviation or the like is likely to occur. To solve the problems, the following countermeasures have been taken.

(1) An encoder was mounted to detect absolute positions of the carriage thereby, thus securing the accuracy of accurate dot forming positions of image. This, however, was a cause of increase of cost.

(2) A stepping motor is often used to drive the carriage. In this case, the stepping motor is often used in the through region outside the self-starting region. Thus, it ramps up at low rotational frequency in the self-starting region and is accelerated up to a predetermined use rotational frequency. For stopping the motor, it is decelerated from the use rotational frequency to ramp down to a low rotational frequency in the self-starting region and to be stopped. The above drive method is usually used. Here, the distance for ramp-up was taken long enough to decrease a velocity change of the carriage at rotational frequencies during the print operation, thereby securing the accuracy of accurate dot forming positions of image. This, however, caused an increase of the apparatus size and an increase of the time necessary for printing.

(3) Further, the velocity change of the carriage was decreased by using the stepping motor of high resolution or adopting the microstep method as a driving method, thereby securing the accuracy of accurate dot forming positions of image. Such structure, however, was also a cause to increase the cost.

The reason why the structures as described in (1), (2), and (3) discussed above are taken is that there are possibilities that the scanning start position of the carriage deviates from that of the previous line because of the positional accuracy of the carriage and that color shear occurs in the case of black being made from three colors of yellow, cyan, and magenta.

SUMMARY OF THE INVENTION

An object of the present invention is to solve the above problems and thus to effect scanning by the carriage after the carriage is located at the start position, even with change of the carriage position before scanning.

Another object of the present invention is to set a difference of the start position of the carriage at every scanning to a distance equal to an integral multiple of a period of phase of motor.

The other objects of the present invention will become apparent in the description of specific embodiments to follow.

DESCRIPTION OF THE PREFERRED EMBODIMENTS

The embodiments of the present invention will be explained with reference to the drawings.

Embodiment 1

Embodiment 1of the present invention will be explained referring to FIG. 1 to FIG. 8.

Figure 1:
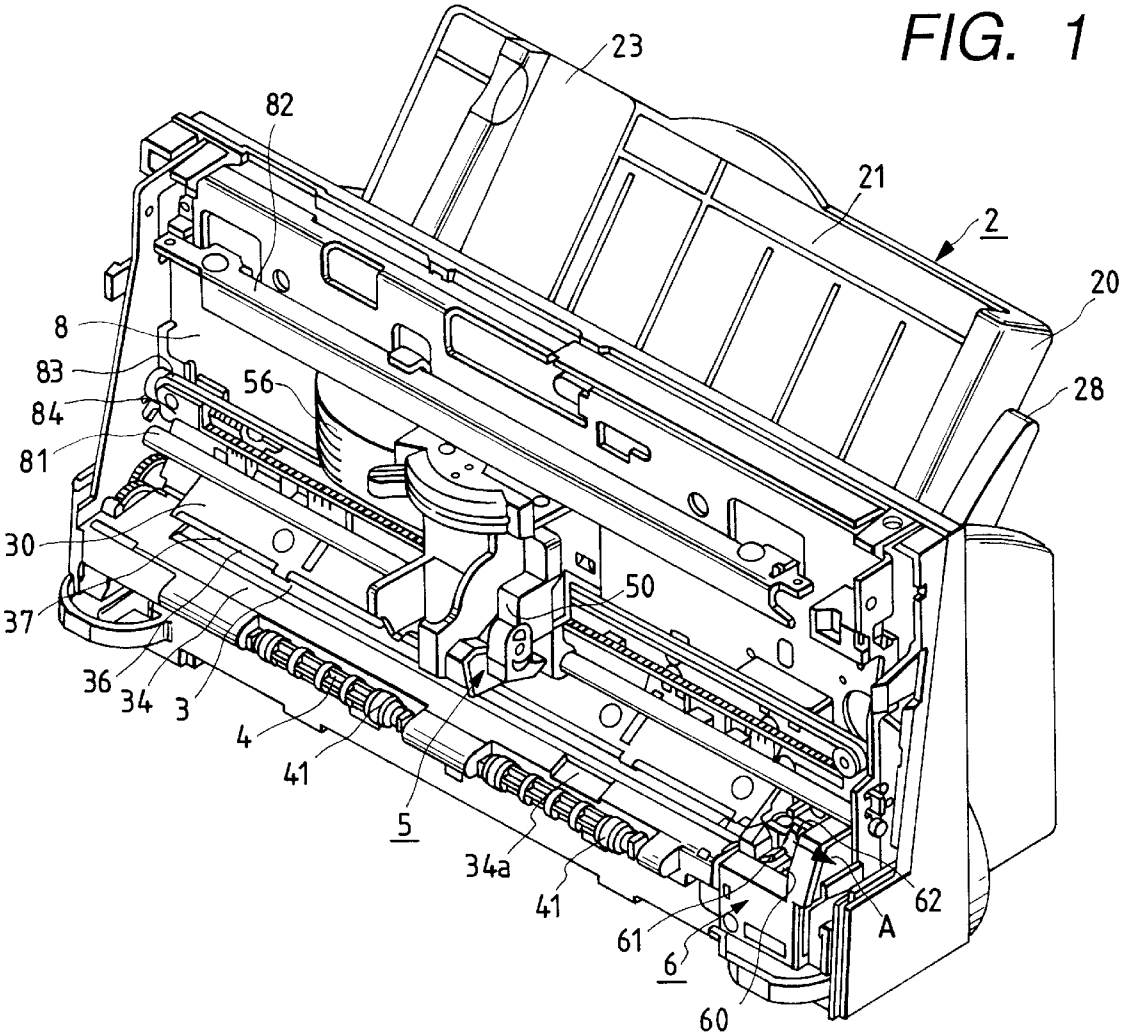
FIG. 1 is a perspective view to show the overall structure of a recording apparatus according to the first embodiment of the present invention.
Figure 2:
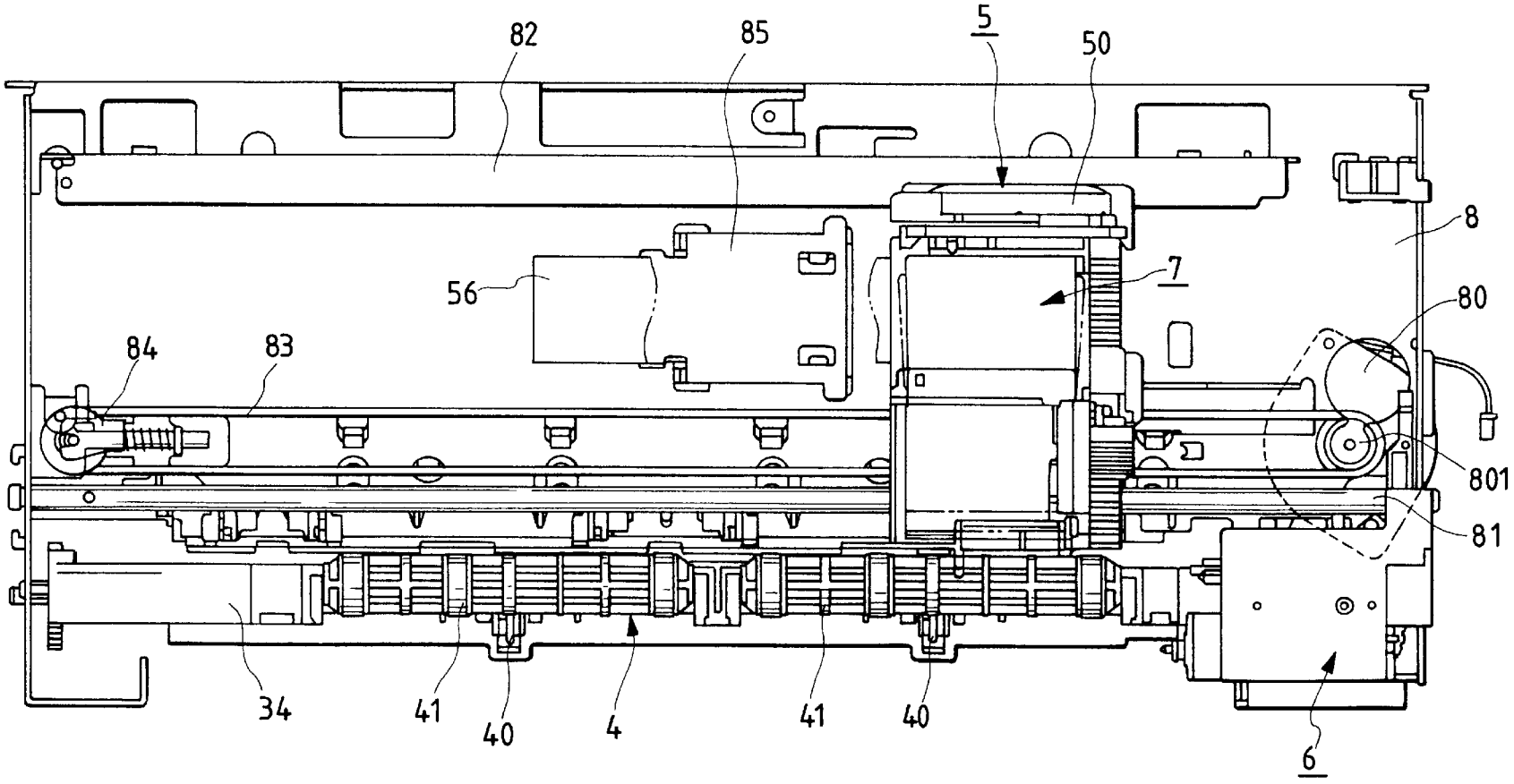
FIG. 2 is a lateral sectional view of the recording apparatus shown in FIG. 1.
Figure 3:
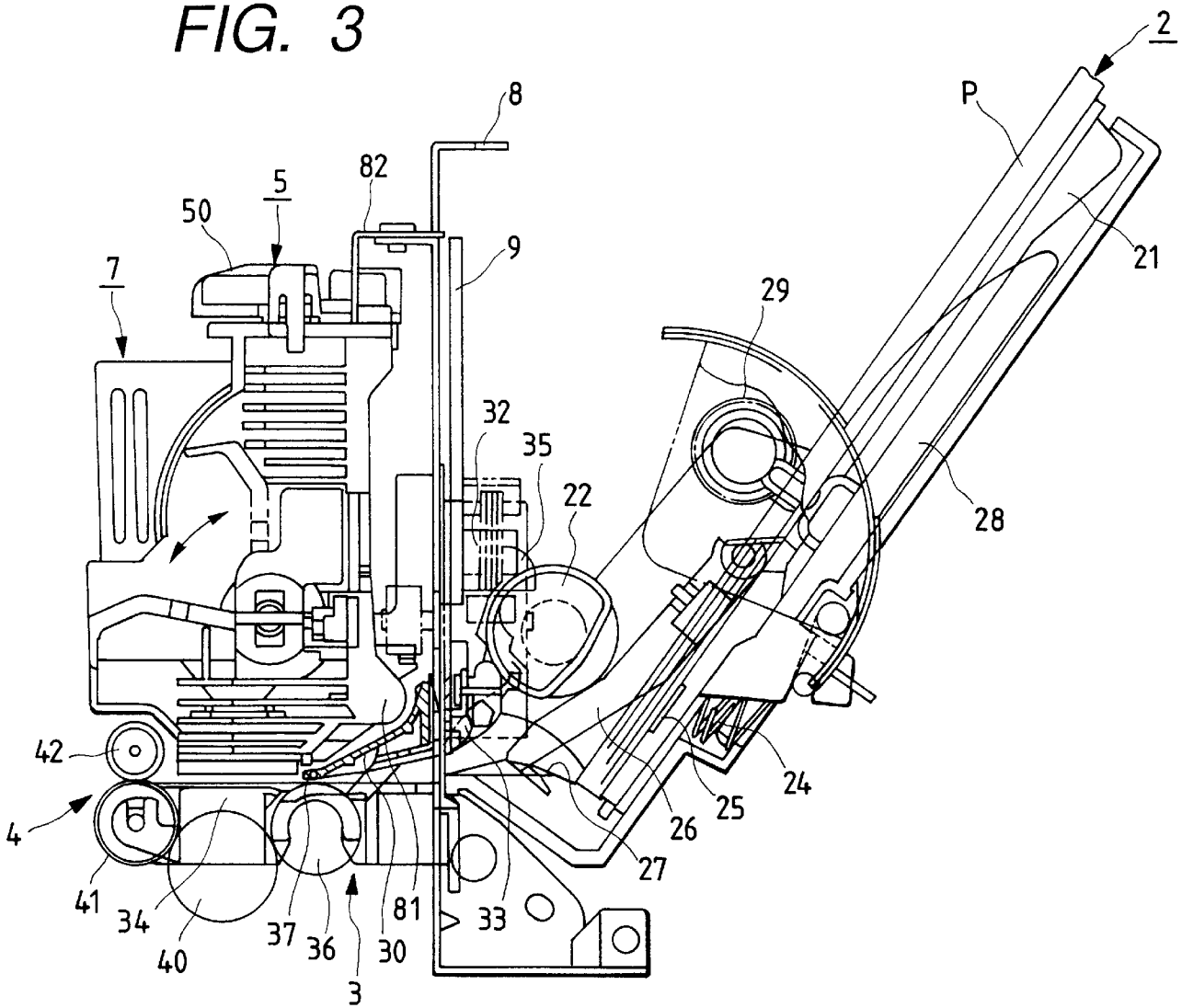
FIG. 3 is a longitudinal sectional view of the recording apparatus shown in FIG. 1.

In this embodiment 1 a print head as a print means is mounted on a carriage and a stepping motor is used as a driving source for moving the carriage. A print apparatus 1 having an automatic sheet supply unit is composed of a sheet supply section 2, a sheet feed section 3, a sheet delivery section 4, a carriage section 5, and a cleaning section 6. Then these will be briefly described in order in respective sections below. FIG. 1 is a perspective view to show the overall structure of the print apparatus 1, FIG. 2 is a lateral sectional view of the print apparatus 1, and FIG. 3 is the longitudinal sectional view of the print apparatus 1.

(A) Sheet Supply Section

The sheet supply section 2 is constructed in such structure that a press plate 21 stacked with recording sheets P as printed media and a supply roller 22 for supplying a recording sheet P are attached to a base 20. A movable side guide 23 is movably mounted on the press plate 21 to regulate the loading position of the recording sheet P. The press plate 21 is rotatable about a rotation shaft connected to the base 20 and is urged by a press plate spring 24 in the opposite direction to the supply roller 22. At a portion of the press plate 21 opposed to the supply roller 22 there is provided a separation pad 25 made of a material having a large coefficient of friction, such as artificial skin, in order to prevent multiple supply of recording sheets P. Further, the base 20 is provided with a separating pawl 26 for separating a recording sheet P from the other recording sheets P as covering a corner in a direction of the recording sheet P, a bank portion 27 integrally formed with the base 20, for separating the recording sheet P such as thick paper that cannot be separated by the separating pawl 26, a changeover lever 28 for making the separating pawl 26 act in the plain paper position and switching the separating pawl 26 so as not to act in the thick paper position, and a release cam 29 for releasing contact between the press plate 21 and the supply roller 22.

In the above configuration, the release cam 29 pushes the press plate 21 down to a predetermined position in a standby state. This releases contact between the press plate 21 and the supply roller 22. When in this state the driving force of carry roller 36 is transmitted through gears or the like to the supply roller 22 and release cam 29, the release cam 29 moves away from the press plate 21, so that the press plate 21 comes to ascend. Then the supply roller 22 comes to touch the recording sheet P, and the recording sheet P is picked up with rotation of the supply roller 22, thus starting supply of sheet P. The recording sheets P are separated one by one by the separating pawl 26 to be fed to the sheet feed section 3. The supply roller 22 and release cam 29 rotate before the recording sheet P is fed to the sheet feed section 3. After that, they are brought again into the standby state where contact is released between the recording sheet P and the supply roller 22, and the driving force from the carry roller 36 is interrupted.

(B) Sheet Feed Section

The sheet feed section 3 has the carry roller 36 for carrying the recording sheet P and a PE sensor 32. The carry roller 36 is in contact with a pinch roller 37 to be driven thereby. The pinch roller 37 is held by a pinch roller guide 30 and the pinch roller 37 is urged against the carry roller 36 by urging force of a pinch roller spring, thereby generating carrying force of recording sheet P. Further, at the entrance of the sheet feed section 3 to which the recording sheet P is carried there are upper guide 33 and platen 34 for guiding the recording sheet P. The upper guide 33 is provided with a PE sensor lever 35, so that the PE sensor 32 detects the leading end and the trailing end of the sheet P by this PE sensor lever 35. Further, a print head for forming an image based on image information (hereinafter referred to as "recording head") 7 is provided downstream of the carry roller 36 in the carrying direction of recording sheet.

In the above arrangement, the recording sheet P sent to the sheet feed section 3 is guided by the platen 34, pinch roller guide 30, and upper guide 33 to be fed to the roller pair, the carry roller 36 and pinch roller 37. Then the PE sensor 32 detects the leading end of the recording sheet P when the PE sensor lever 35 is actuated by the recording sheet P carried thereto. Then the print position of recording sheet P is calculated based on the reference of the thus detected position. The recording sheet P is carried onto the platen 34 with rotation of the roller pair 36, 37 by an LF motor not shown.

In the case of this example, the recording head 7 employed is an ink jet recording head, easy to replace, incorporated with an ink tank. This recording head 7 can supply heat to ink by a heater or the like. This heat causes film boiling of the ink, and the ink is ejected through the nozzle of recording head 7 by pressure change resulting from growth or contraction of a bubble due to the film boiling, thereby forming an image on the recording sheet P.

(C) Carriage Section

The carriage section 5 has a carriage 50 to which the recording head 7 is to be mounted. The carriage 50 is supported by a guide shaft 81 for translationally moving the carriage 50 in the directions perpendicular to the carrying direction of recording sheet P, and a guide rail 82 for holding the rear end of the carriage 50 to maintain a clearance between the recording head 7 and the recording sheet P. These guide shaft 81 and guide rail 82 are attached to a chassis 8. The carriage 50 is driven through a timing belt 83 by a carriage motor 80 mounted on the chassis 8. This timing belt 83 is stretched and retained by an idle pulley 84. Further, the carriage 50 is equipped with a flexible board 56 for transferring a drive signal from an electric board to the recording head 7.

In the above arrangement, when an image is formed on the recording sheet P, the roller pair 36, 37 carries the recording sheet P to a row position for formation of image (or to a position in the carrying direction of recording sheet P), and the carriage motor 80 moves the carriage 50 to a column position for formation of image (or to a position in the direction perpendicular to the carrying direction of the recording sheet P), thereby setting the recording head 7 to be opposed to the image forming position. After that, according to the signal from the electric board, the recording head 7 ejects the ink toward the recording sheet P to form the image.

(D) Sheet Delivery Section

In the sheet delivery section 4 a transmission roller 40 is in contact with the carry roller 36 and the transmission roller 40 is also in contact with a delivery roller 41. Thus, the driving force of the carry roller 36 is transmitted through the transmission roller 40 to the delivery roller 41. A spur 42 is in contact with the delivery roller 41 so as to rotate as driven by the delivery roller 41. By the above arrangement, the recording sheet P on which the image was formed at the carriage section 5 is pinched between the delivery roller 41 and the spur 42 to be carried and delivered onto a delivery tray, not shown, or the like.

(E) Cleaning Section

The cleaning section 6 is composed of a pump 60 for cleaning the recording head 7, a cap 61 for preventing drying of the recording head 7, and a drive changeover arm 62 for changing over the driving force from the carry roller 36 between the sheet supply section 2 and the pump 60. The drive changeover arm 62 fixes a planet gear (not shown) arranged to rotate about the axis of the carry roller 36, at a predetermined position during periods except for those of sheet supply and cleaning, whereby no driving force is transmitted to the sheet supply section 2 and to the pump 60 during such periods. When the drive changeover arm 62 moves in the direction of arrow A with movement of the carriage 50, the planet gear becomes free, and the planet gear moves in accordance with forward rotation or backward rotation of the carry roller 36. When the carry roller 36 rotates forward, the driving force is transmitted to the sheet supply section 2; when it rotates backward, the driving force is transmitted to the pump 60.

(Driving method of motor)

Next explained is the driving method of the stepping motor used for driving of the carriage section 5.

Figure 4:
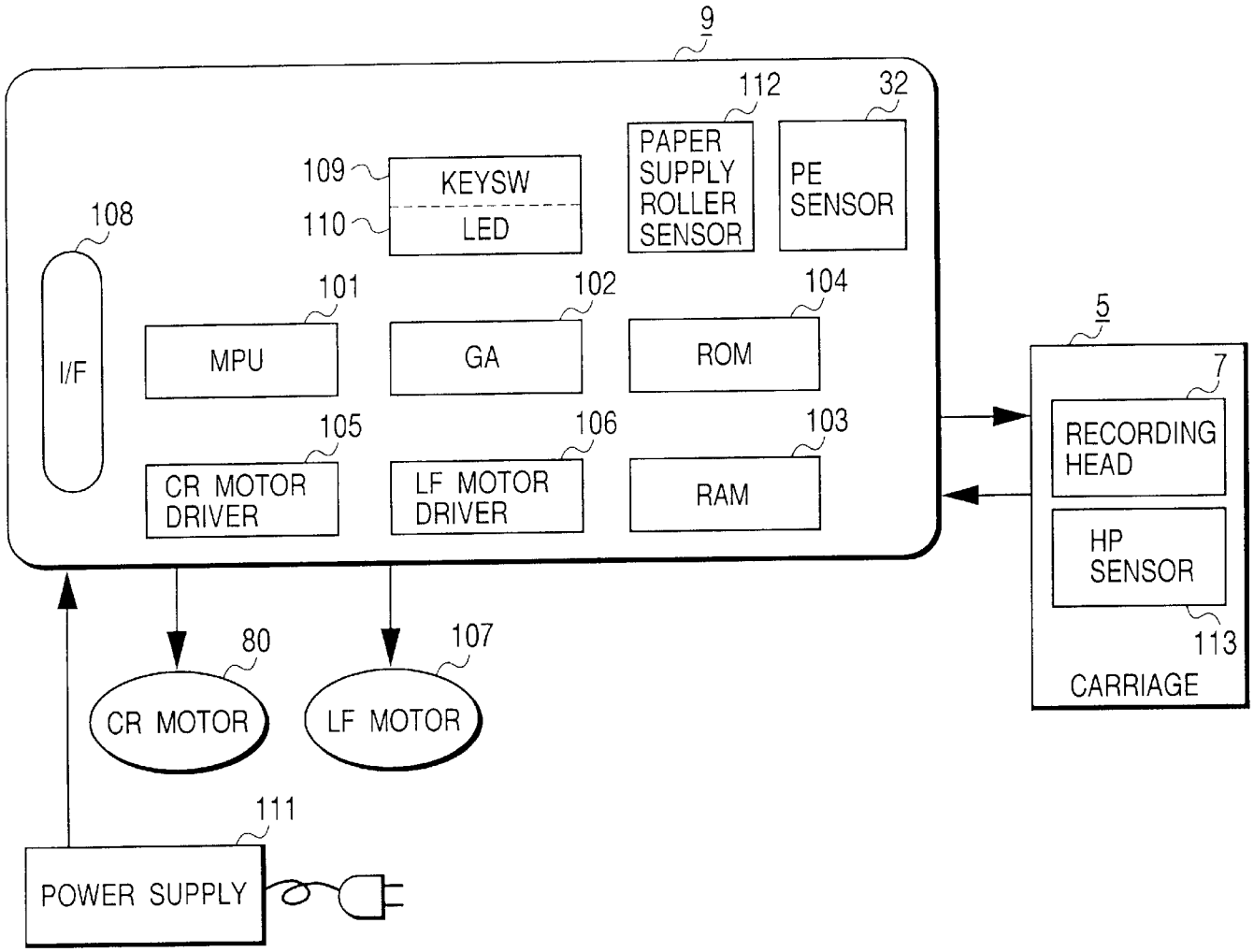
FIG. 4 is a block structural diagram of the recording apparatus shown in FIG. 1.

FIG. 4 is a block diagram to show the structure of a driving system of the motor. In FIG. 4, reference numeral 101 designates an MPU for executing control of printer, including the drive of motor, 102 a gate array, 103 a D-RAM, 104 an ROM, 105 a CR motor driver, 106 an LF motor driver, 80 a carriage motor (hereinafter referred to as "CR motor"), and 107 a sheet feed motor (LF motor). A specific example of the CR motor driver 105 is a driver of the current bipolar chopping method. Instructions of drive frequency and current of the CR motor 80 are given according to set parameters from the MPU 101 to the CR motor driver 105, and the CR motor 80 is driven based on the drive frequency and current. A specific example of the CR motor 80 is a PM type stepping motor having the diameter 42 mm and the resolution of 48 steps. Ferrite or the like is used for the roller magnetic member of the motor.

In the through region of ramp-up of the CR motor 80, the number of pulses applied is approximately 25 to 50. The drive is the one-two-phase-on drive wherein the start pulse frequency is approximately 100 pps and the frequency in a predetermined constant-speed region is approximately 1000 pps. In this case, a drive curve during the period in which the CR motor 80 starts and then reaches the constant-speed region, which is a drive curve of ramp-up as an approach run in which the carriage 50 starts moving and then reaches the constant speed, is determined so as to form an S-shaped curve connecting the inflection point of a cubic curve, thereby raising the drive pulse of the motor 80 up to the frequency of about 1000 pps for the predetermined constant speed. A drive curve of ramp-down to decelerate to stop the carriage 50 is approximately symmetric with the drive curve of ramp-up.

Figure 5A:
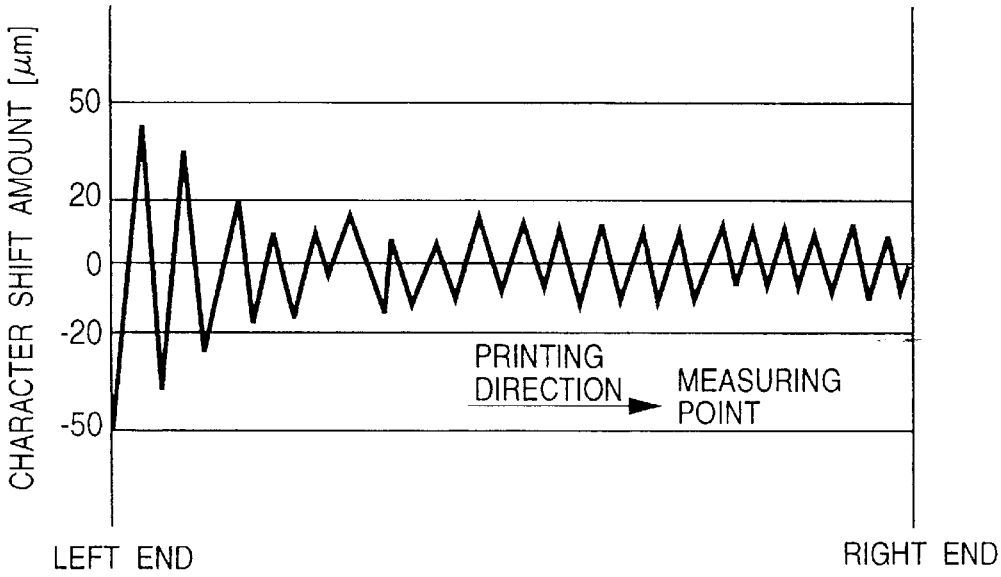
FIG. 5A is an explanatory drawing of the positional accuracy in the normal operation of the carriage shown in FIG. 1.
Figure 5B:
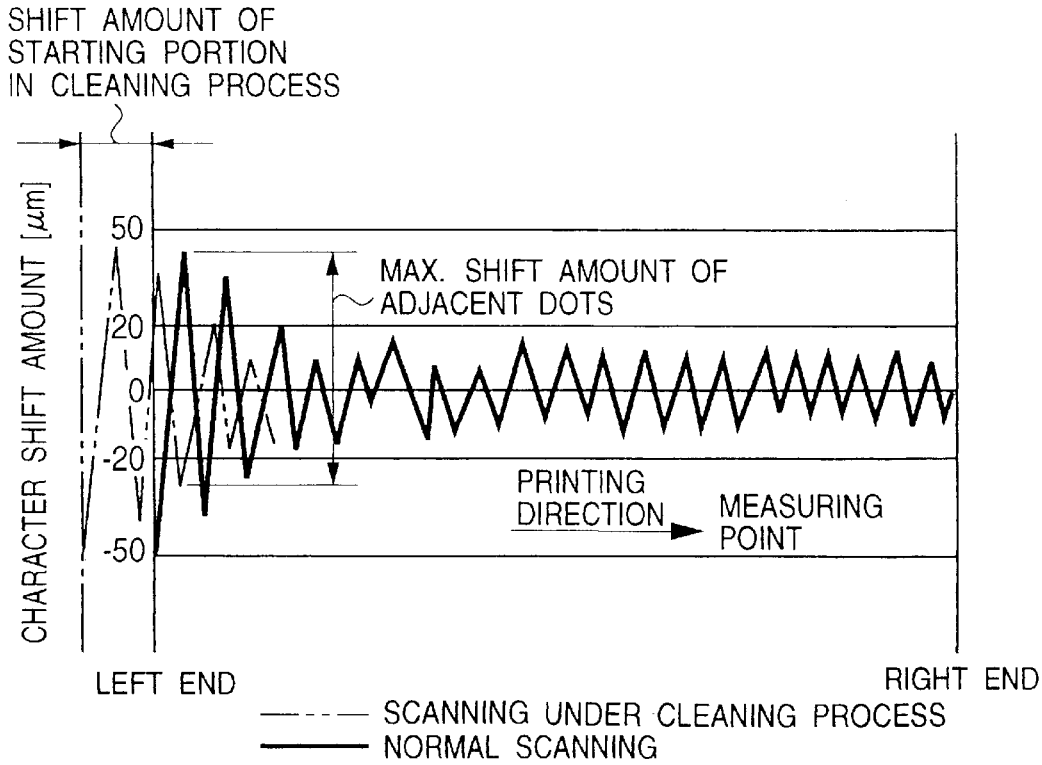
FIG. 5B is an explanatory drawing of the positional accuracy in cleaning of the carriage shown in FIG. 1.

When the CR motor 80 is driven in this manner, the accuracy (which is deviation when dots are formed at intervals of one tenth inch) of the print position (hereinafter referred to as "printing position") becomes slightly worse immediately after start of the CR motor 80, as shown in FIG. 5A, indicating the deviation of ±40 to 50 $\mu$m. Then the accuracy is stabilized to be ±10 to 20 $\mu$m. FIG. 5A and FIG. 5B, described hereinafter, show examples in which printing is carried out from the left end to the right end of the recording sheet P. This apparatus requires cleaning of the recording head 7 at constant intervals, and thus goes into the cleaning operation even during printing. In this case, when the CR motor 80 is started from the cleaning position as in the conventional apparatus, the scanning start position of the carriage 50 deviates in that line, as shown in FIG. 5B, so that the printing position accuracy of only that line changes, as illustrated by the chain double-dashed line in FIG. 5B, causing the maximum deviation of 70 to 80 $\mu$m in some cases. It was a cause of ruled line deviation or print unevenness upon the above fine printing.

Figure 6:
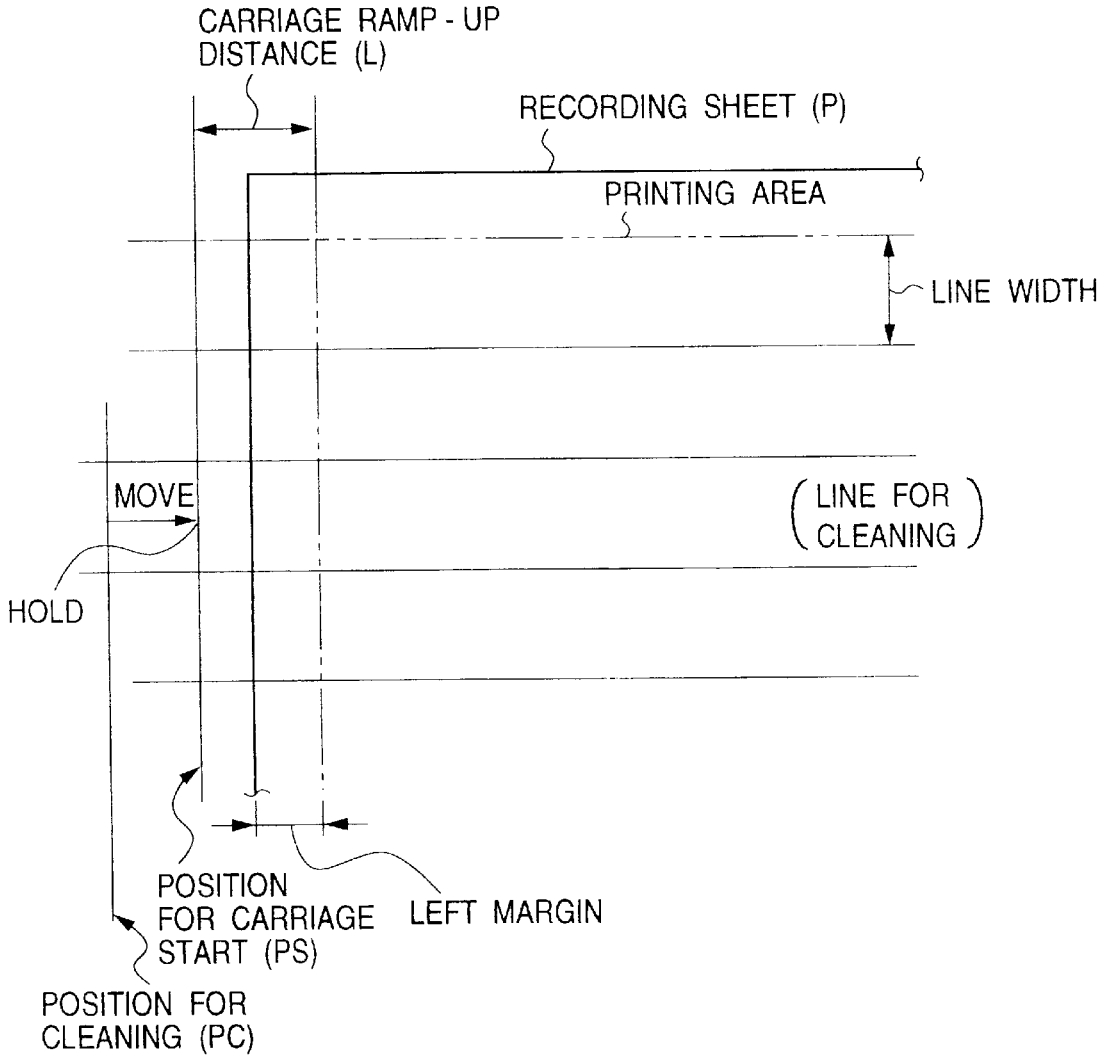
FIG. 6 is an explanatory drawing of drive control of the carriage to show a first example in the first embodiment of the present invention.

In the first example of this Embodiment 1, as shown in FIG. 6, the start position upon each scanning of the carriage is aligned with the start position PS shifted by ramp-up distance L of the carriage 50 before from the edge of the printing area as a print region in the recording sheet P. Namely, the edge of the printing area is located at a position shifted by the left margin of 2 to 5 mm from the left edge of the recording sheet P. Here, the ramp-up distance is a moving distance of the carriage 50 during the ramp-up period in which the carriage 50 starts moving and then reaches the constant speed. The carriage start position PS is defined at the position shifted by the distance L necessary for ramp-up of the carriage 50 before from this edge of the printing area. In this arrangement, after the cleaning operation, the carriage 50 first moves from the cleaning position PC to the predetermined same start position (the carriage start position PS) and stops there, and then it goes into the ramp-up operation. Therefore, the printing position accuracy can be kept nearly constant between printing of previous line and printing of succeeding line, as shown in FIG. 5A, so as to decrease deviation of adjacent dots. This can suppress the ruled line deviation or the printing unevenness upon the aforementioned fine printing, thus realizing printing of high-definition image. This effect can be achieved at low cost and in small apparatus size. Further, an easy and simple control system can be used to realize the processing of regulating the start positions of the carriage 50 at the same position PS.

The foregoing described the example of printing from the left edge of the recording sheet P, but the same can be applied to the printing case from the right edge in the opposite direction.

The second example of this embodiment 1 will be next explained. The first example of this embodiment 1 was arranged in such a manner that the start position upon each scanning of the carriage 50 was aligned with the start position PS shifted by the ramp-up distance of the carriage 50 before from the edge of the printing area of the recording sheet P as a printed medium, but the start position upon each scanning of the carriage 50 may be aligned with a position PS shifted by the ramp-up distance L of the carriage 50 from the edge of an image to be formed upon each scanning, as shown in FIG. 7.

Figure 7:
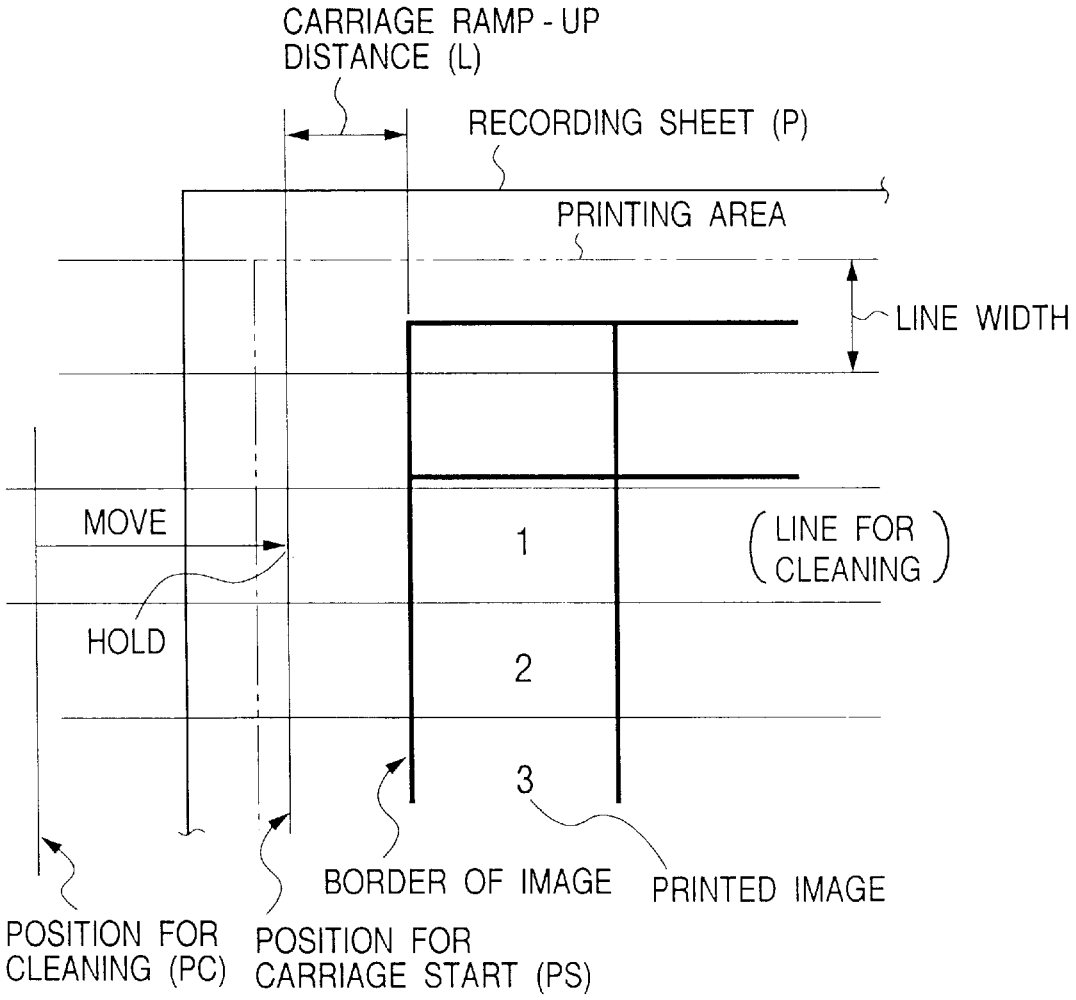
FIG. 7 is an explanatory drawing of drive control of the carriage to show a second example in the first embodiment of the present invention.

Namely, as shown in FIG. 7, the start position PS is defined at the position shifted by the distance L necessary for ramp-up of the carriage 50 before the edge of an image formed upon each scanning. In this case, as compared with the first example, unnecessary scanning of the carriage 50 is omitted in printless portions, which can decrease the printing period. Further, an easy and simple control system can be used to realize the setting processing of the start position PS.

The third example of this embodiment 1 is next described. The first example of this embodiment 1 was arranged in such a manner that the start position upon each scanning of the carriage 50 was aligned with the start position PS shifted by the ramp-up distance L of the carriage 50 from the edge of the printing area of the recording sheet P as a printed medium, but the start position upon each scanning of the carriage 50 may be aligned with a start position shifted by the ramp-up distance L of the carriage 50 from the extreme edge in each block of consecutive images, as shown in FIG. 8.

Figure 8:
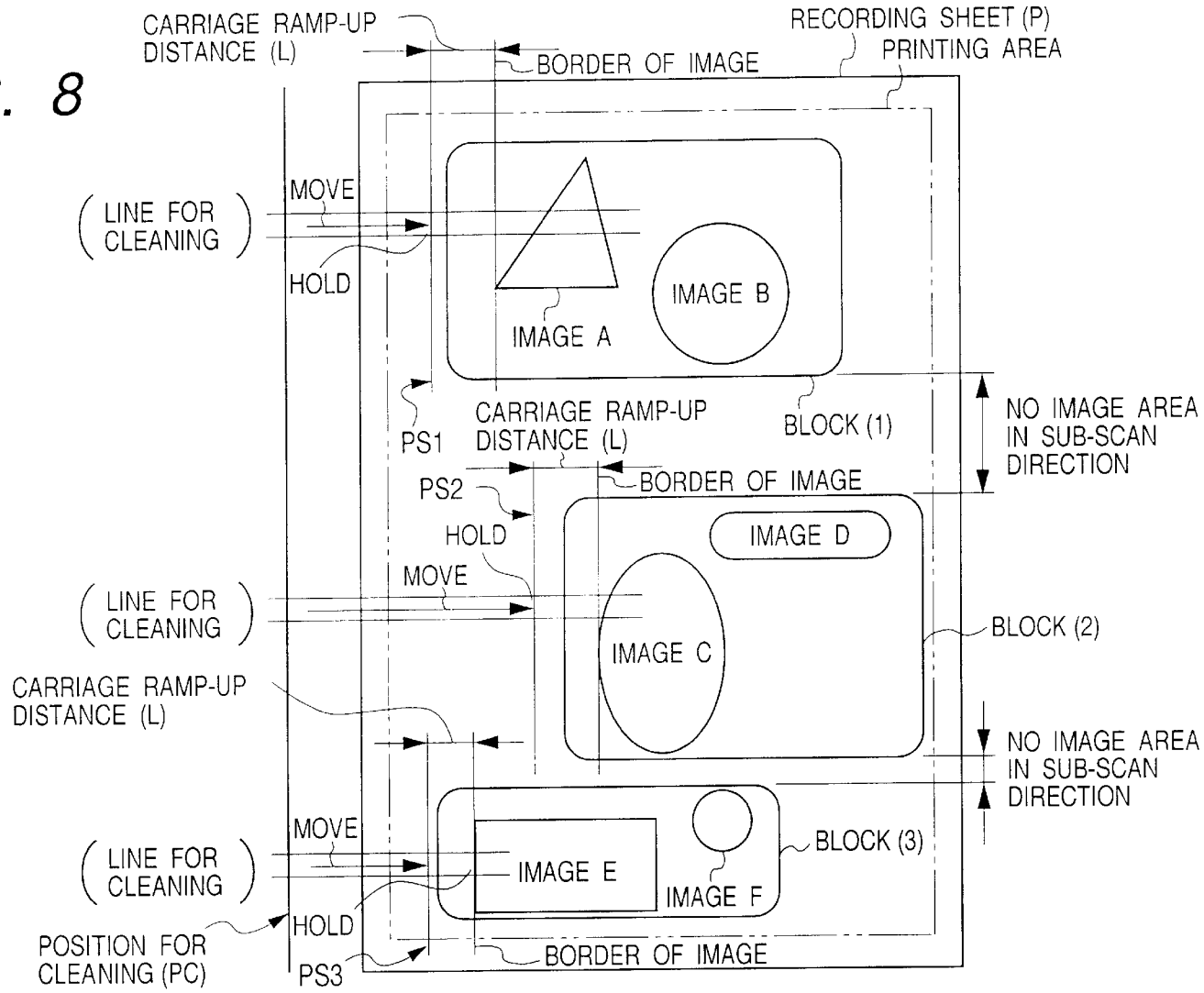
FIG. 8 is an explanatory drawing of drive control of the carriage to show a third example in the first embodiment of the present invention.

Namely, as shown in FIG. 8, a continuous image in the sub-scan direction is selected every block in a page of the recording sheet P. In FIG. 8 the page is divided into three blocks 1, 2, 3. An image right before the extreme edge is selected in this block 1, 2, 3, and scanning of the carriage 50 is started from the start position PS1, PS2, PS3 shifted by the distance L necessary for ramp-up of the carriage 50 before this extreme edge. This arrangement can control the deviation of image dots in the low level even with an image of an obliquely drawn line or curve. Further, as compared with the first example, unnecessary scanning of the carriage 50 is omitted in printless portions, which can decrease the printing period.

The first or second example of this embodiment 1 was arranged in such a manner that, for the all images, the start position upon each scanning of the carriage 50 was aligned with the start position in the case of printing from the edge of the printing area of recording sheet P as the foregoing printed medium or the start position upon each scanning of the carriage 50 was aligned with the start position in formation of image upon each scanning, but, if an image can be formed by single scan of the carriage 50 like one-pass position of character and it is not continuous to an image upon next scanning, i.e., if the image is not continuous in the sub-scan direction, the process for aligning or matching the start position upon each scanning of the carriage 50 can be omitted.

Therefore, the printing period can be decreased by such arrangement as to execute the processing of aligning or matching the start position upon each scanning of the carriage 50 only if necessitated.

As detailed above, this embodiment 1 is arranged in such a manner that the start position of scanning of the carriage is aligned upon each scanning and the speed change of the carriage upon each scanning is thus kept constant, whereby the high-definition image can be formed as controlling the deviation of forming positions of adjacent pixels of image in the low level. Accordingly, the present embodiment is free of the increase of the cost due to the encoder, the high-resolution motor, or the like. Further, the distance upon ramp-up of the motor for driving the carriage can be short, and therefore, the present embodiment is also free of the increase of apparatus size.

Embodiment 2

Embodiment 2 of the present invention will be explained referring to FIG. 9 to FIGS. 13A, 13B. Since the structure of this embodiment 2 is the same as that of foregoing embodiment 1 shown in FIG. 1 to FIG. 5, the detailed description thereof is omitted herein.

Figure 9:
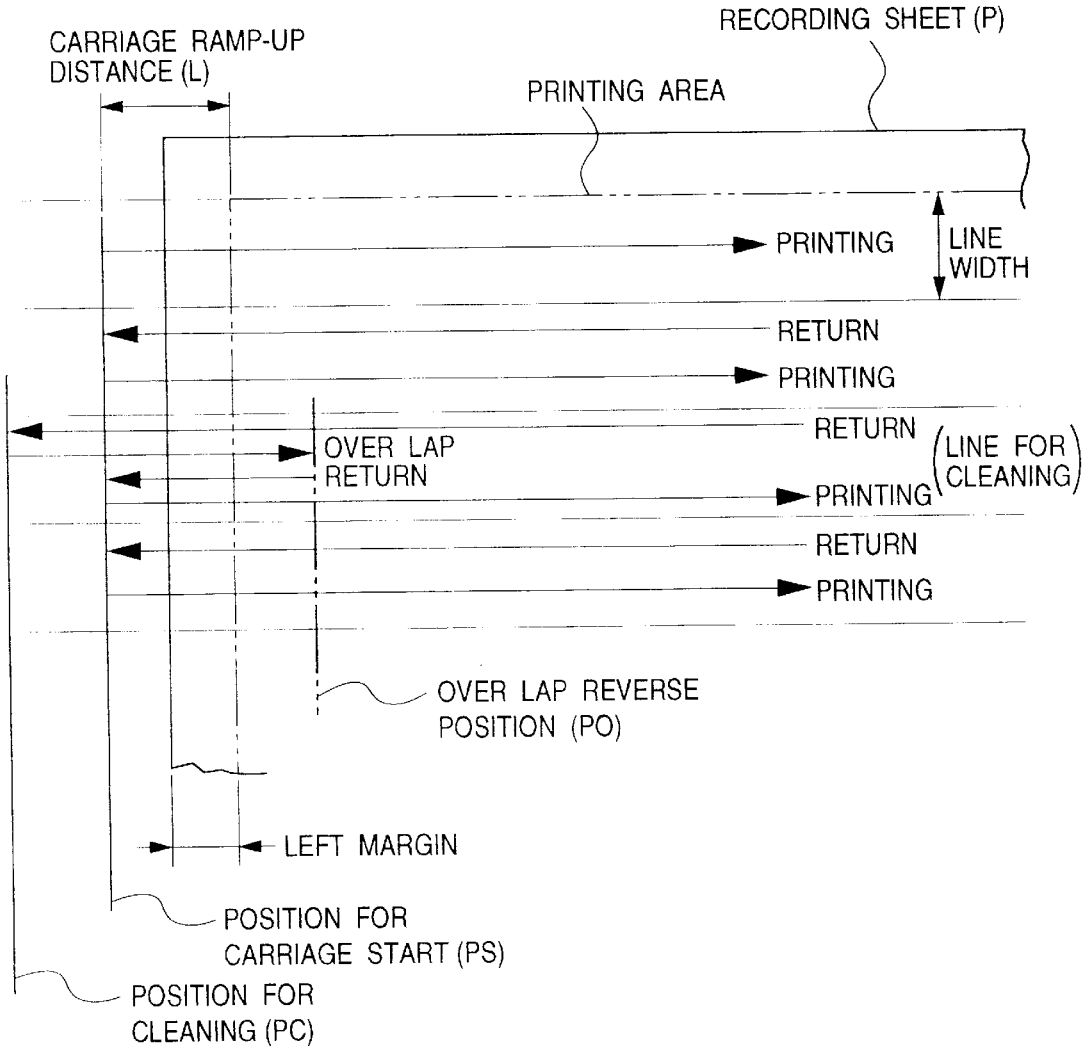
FIG. 9 is an explanatory drawing of drive control of the carriage to show a first example in the second embodiment of the present invention.

In the first example of this embodiment 2, as shown in FIG. 9, the start position upon each scanning of the carriage 50 is aligned with the start position PS shifted by the ramp-up distance L of the carriage 50 before the edge of the printing area as a print region of the recording sheet P. Namely, the edge of the printing area is located at the position shifted by the left margin of 2 to 5 mm from the left edge of the recording sheet P. Here, the ramp-up distance is the moving distance of the carriage 50 during the ramp-up period in which the carriage 50 starts moving and then reaches the constant speed. The carriage start position PS is defined at the position shifted by the distance L necessary for the ramp-up of the carriage 50 before from the edge of this printing area.

In the normal operation without intervention of the cleaning operation, after completion of one-line printing operation, the carriage 50 is returned to the left in FIG. 9 up to the carriage start position PS, and then it is reversed at the carriage start position PS to start moving to the right in FIG. 9 for the next printing operation. With inclusion of the cleaning operation, first, the carriage 50 returning to the cleaning position PC is once moved up to an overlap reverse position PO across the carriage start position PS, the carriage is reversed at the overlap reverse position PO and then is returned (or overlap-returned) back to the carriage start position PS, and thereafter the carriage is again reversed at the carriage start position PS to start moving to the right in FIG. 9 for the next printing operation. Therefore, after execution of the cleaning operation, the carriage 50 is reversed at the carriage start position PS in the same manner as in the normal operation and then goes into the ramp-up operation for the next printing operation.

As described, after entering the cleaning operation, the carriage 50 performs the same reverse operation as in the normal printing, before start of next printing operation, and then goes into the ramp-up operation from the same start position (or from the carriage start position PS), whereby the same behavior of the carriage 50 is repeated as in the normal printing operation. Therefore, the printing position accuracy is nearly equal between printing of previous line and printing of succeeding line as shown in FIG. 5A, which decreases the deviation of adjacent dots, thus realizing the high-definition image as suppressing the ruled-line deviation or the printing unevenness upon the foregoing fine printing. This effect can be realized at low cost and in small apparatus size. Further, an easy and simple control system can realize the control for regulating the start positions of the carriage 50 at the same position PS.

The foregoing described the example of printing from the left edge of the recording sheet P, but the same can be applied to the printing case from the right edge in the opposite direction.

The second example of this embodiment 2 is next explained.

Figure 10:
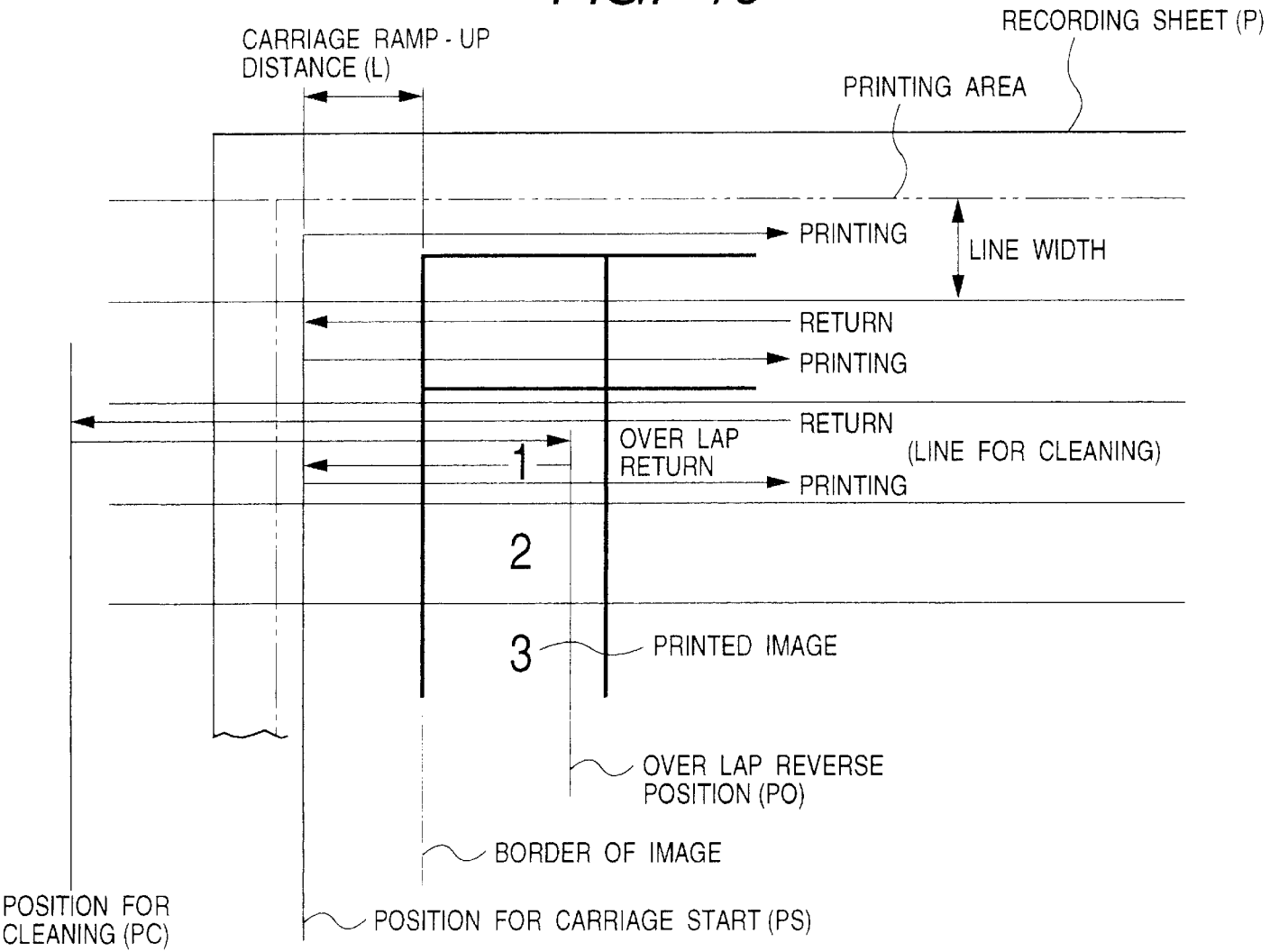
FIG. 10 is an explanatory drawing of drive control of the carriage to show a second example in the second embodiment of the present invention.

The first example of this embodiment 2 was arranged in such a manner that the start position upon each scanning of the carriage 50 was aligned with the start position PS shifted by the ramp-up distance of the carriage 50 before from the edge of the printing area of the recording sheet P as a printed medium, but the start position upon each scanning of the carriage 50 may be aligned with the position PS shifted by the ramp-up distance L of the carriage 50 from the edge of an image to be formed upon each scanning, as shown in FIG. 10.

Namely, as shown in FIG. 10, the start position PS is defined at the position shifted by the distance L necessary for the ramp-up of the carriage 50 before from the edge of an image formed upon each scanning. In this case, as compared with the first example, unnecessary scanning of the carriage 50 is omitted in printless portions, which can decrease the printing period. Further, the setting process of the start position PS can be realized by easy control.

Figure 11A:
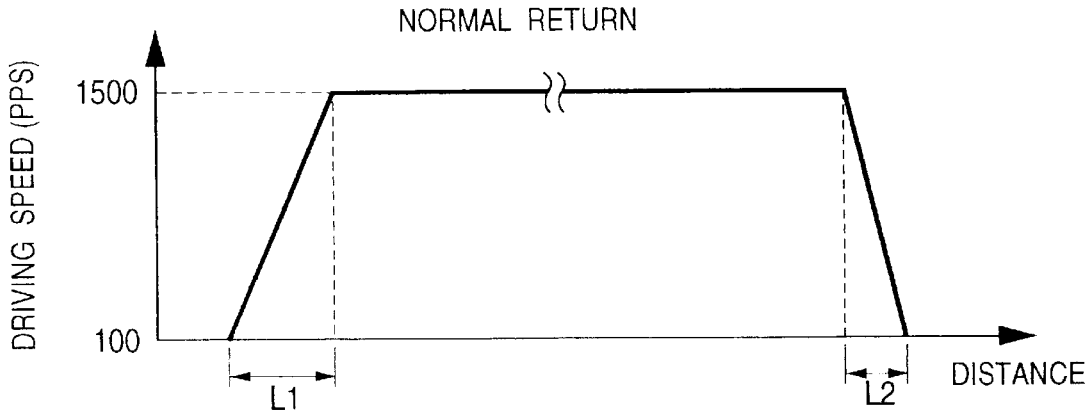
FIG. 11A is a drive characteristic diagram of the carriage upon normal return in the second example shown in FIG. 10.
Figure 11B:
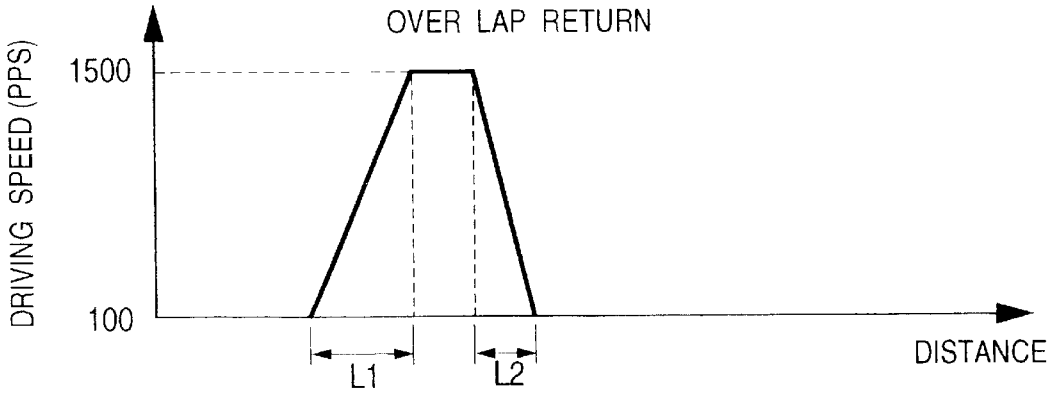
FIG. 11B is a drive characteristic diagram of the carriage upon overlap return in the second example shown in FIG. 10.

Further, the drive speed during overlap return, during which the carriage 50 returns from the overlap reverse position PO exceeding the start position PS back thereto, may be equal to the drive speed during normal printing return. For example, as shown in FIGS. 11A and 11B, when the constant-speed frequency upon return of the carriage 50 is approximately 1500 pps, in the return upon normal printing and in the overlap return the speed is raised in the same ramp-up pattern up to 1500 pps and is decreased in the same ramp-down pattern. In this manner, the same drive is effected for ramp-up and for ramp-down. In FIGS. 11A and 11B, L1 represents a distance necessary for ramp-up and L2 a distance necessary for ramp-down. By equalizing the drive speed of the carriage 50 during overlap return, in which the carriage 50 moves up to the overlap reverse position PO the predetermined distance over the start position PS, then turns its traveling direction, and returns to the start position PS, to the drive speed during the normal printing, the constant behavior of the carriage 50 is attained regardless of inclusion of the cleaning operation, so that closer speed changes can be repeated.

The third example of this embodiment 2 is next explained.

Figure 12:
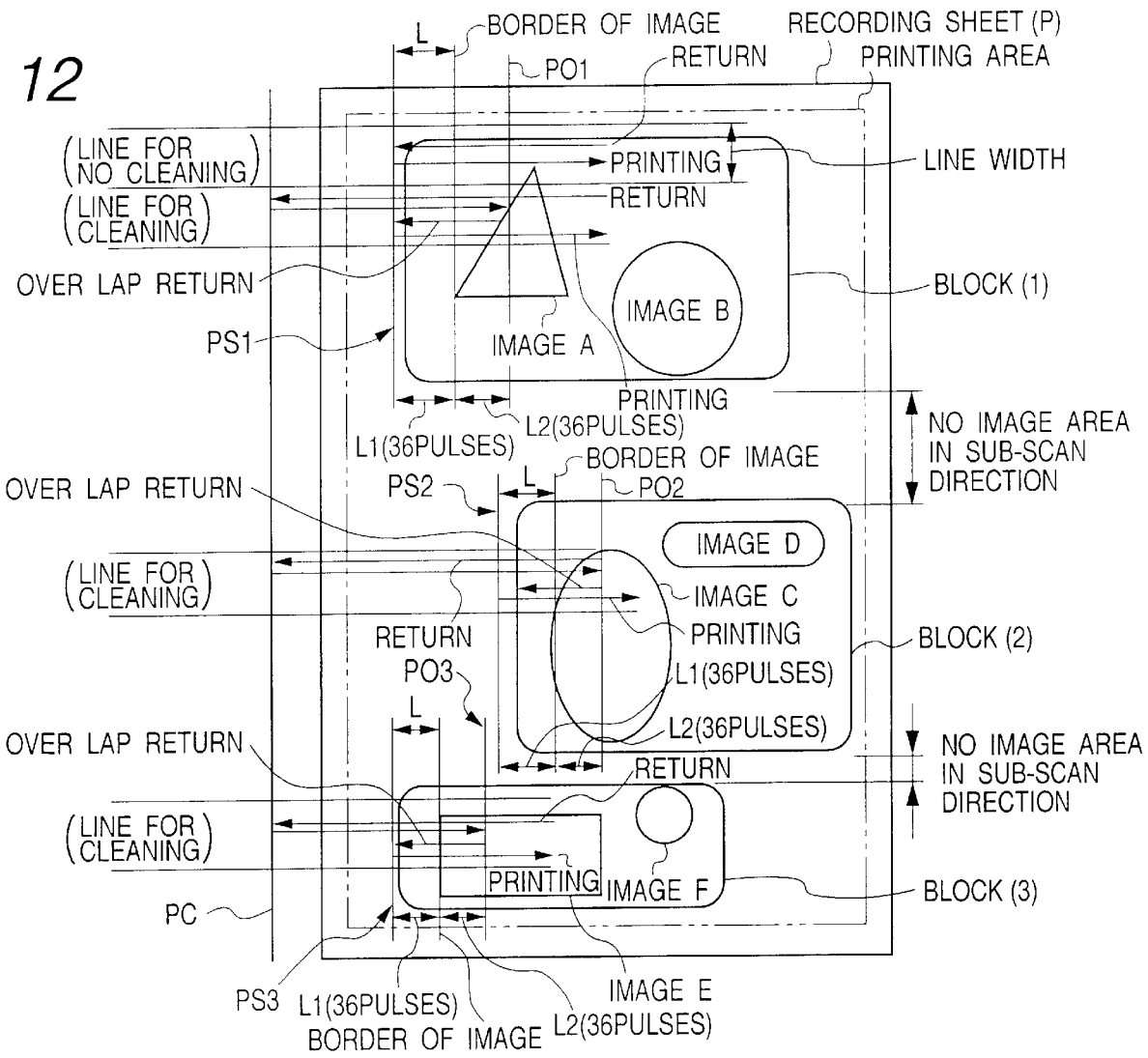
FIG. 12 is an explanatory drawing of drive control of the carriage to show a third example in the second embodiment of the present invention.

The first example of this embodiment 2 was arranged in such a manner that the start position upon each scanning of the carriage 50 was aligned with the start position PS shifted by the ramp-up distance L of the carriage 50 from the edge of the printing area of the recording sheet P as a printed medium, but the start position upon each scanning of the carriage 50 may be aligned with the start position shifted by the ramp-up distance L of the carriage 50 from the extreme edge in each block of consecutive images, as shown in FIG. 12.

Namely, as shown in FIG. 12, a continuous image in the sub-scan direction is selected every block in a page of the recording sheet P. In FIG. 12 the page is divided into three blocks 1, 2, 3. An image right before the extreme edge is selected in this block 1, 2, 3, and scanning of the carriage 50 is started from the start position PS1, PS2, PS3 shifted by the distance L necessary for ramp-up of the carriage 50 before this extreme edge. The overlap reverse position PO1, PO2, PO3 for each block 1, 2, 3 is located at the position shifted the predetermined distance to the right in FIG. 12 from each start position PS1, PS2, PS3. This arrangement can control the deviation of image dots in the low level even with an image of an obliquely drawn line or curve. Further, as compared with the first example, unnecessary scanning of the carriage 50 is omitted in printless portions, which can decrease the printing period.

Figure 13A:
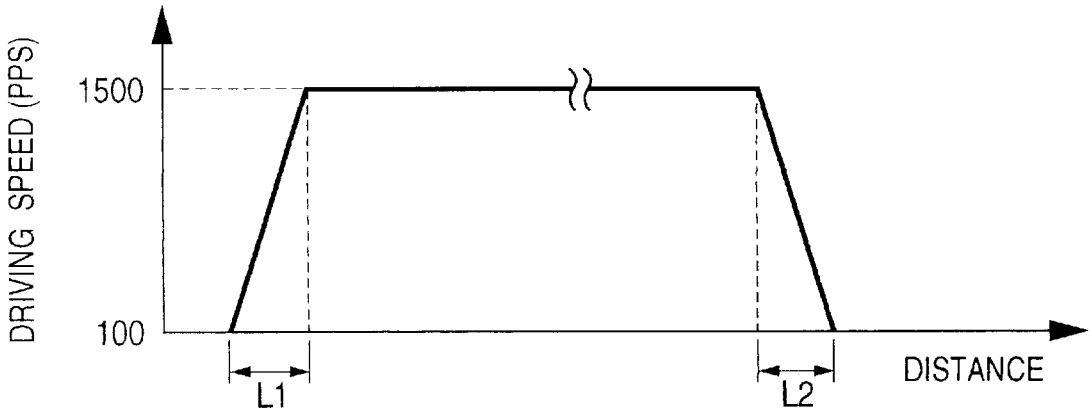
FIG. 13A is a drive characteristic diagram of the carriage upon normal return in the third example shown in FIG. 12.
Figure 13B:
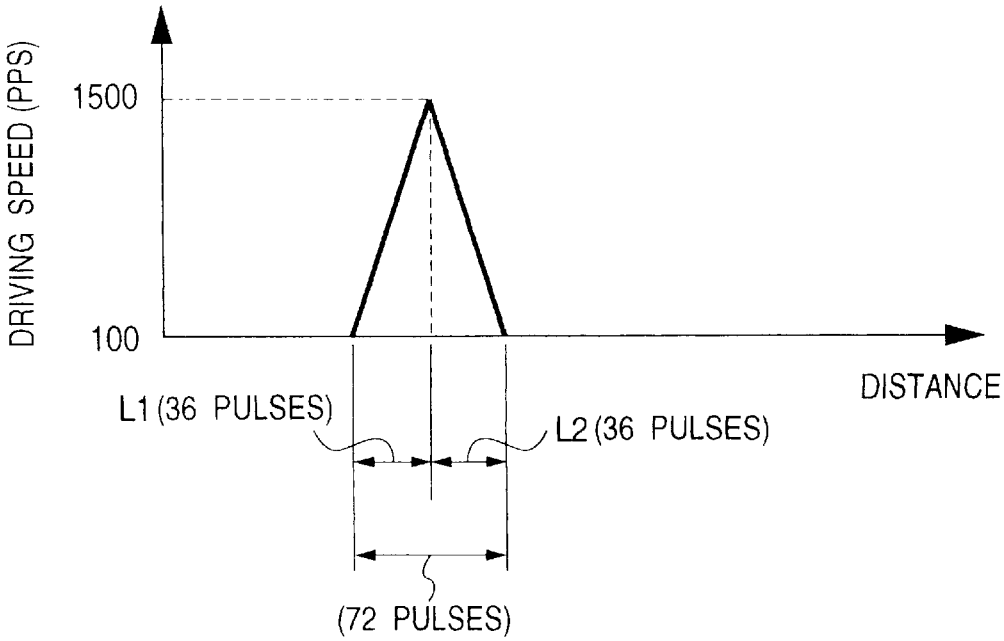
FIG. 13B is a drive characteristic diagram of the carriage upon overlap return in the third example shown in FIG. 12.

Further, in the same manner as in the above second example, the drive speed during overlap, in which the carriage 50 returns from the overlap position PO (PO1, PO2, PO3) exceeding the start position PS back to the start position PS (PS1, PS2, PS3), may be equalized to the drive speed during the normal printing return. Since the constant-speed frequency during return of the carriage 50 is approximately 1500 pps, in the return during normal printing and in the overlap return the speed is raised in the same ramp-up pattern up to 1500 pps and is decreased in the same ramp-down pattern. In this case, as shown in FIG. 12 and FIGS. 13A, 13B, the distance between the start position PS (PS1, PS2, PS3) and the overlap reverse position PO (PO1, PO2, PO3) may be set nearly to the sum of the ramp-up distance Li and the ramp-down distance L2 upon return of carriage 50 during normal printing. For example, if each of the ramp-up distance L1 and the ramp-down distance L2 is 36 pulses of the CR motor 80, the distance between the start position PS (PS1, PS2, PS3) and the overlap reverse position is set nearly to 72 pulses of (L1+L2). This permits the same driving speed and the same behavior of the carriage 50 as in the normal printing to be realized within the shortest distance even with inclusion of the cleaning operation.

The first or second example of this embodiment 2 was arranged in such a manner that, for the images, the start position upon each scanning of the carriage 50 was aligned with the start position in the case of printing from the edge of the printing area of recording sheet P as the printed medium or the start position upon each scanning of the carriage 50 was aligned with the start position in formation of image upon each scanning, but, if an image can be formed by single scan of the carriage 50 like one-pass position of character and it is not continuous to an image upon next scanning, i.e., if the image is not continuous in the sub-scan direction, the process for aligning or matching the start position upon each scanning of the carriage 50 can be omitted.

Therefore, the printing period can be decreased by such arrangement as to execute the processing of aligning or matching the start position upon each scanning of the carriage 50 only if necessitated.

As detailed above, this embodiment 2 can enjoy the following advantages, because the start positions of scanning of the carriage are aligned in the respective scanning steps and the carriage is started for ramp-up under the same conditions.

(1) Since the speed change of the carriage upon each scanning is identical, a high-definition image can be formed as controlling the deviation of adjacent dots in the low level upon formation of image. Accordingly, the present embodiment is free of the increase of cost due to the encoder, the high-resolution motor, or the like for controlling the drive of carriage. It is also free of an increase of the apparatus size, because the distance can be set short upon ramp-up of the motor for driving the carriage.

(2) In the present embodiment, the drive speed of the carriage in the overlap return, in which the carriage moves the predetermined distance over the start position to the reverse position and returns to the start position, is made nearly equal to the drive speed during the normal print operation, whereby the behavior of the carriage becomes constant and the speed changes can be closer.

(3) Since the distance between the start position and the reverse position of the carriage is set nearly to the sum of the ramp-up distance and the ramp-down distance of the carriage, the constant drive speed of carriage and the constant behavior of the carriage can be realized within the shortest distance.

(4) By the arrangement wherein the start position upon each scanning of the carriage is aligned with the position shifted at least the ramp-up distance of the carriage before from the edge of the printing area of the printed medium, the drive of carriage can be realized by very easy control.

(5) By the arrangement wherein the start position upon each scanning of the carriage is aligned with the position shifted at least the ramp-up distance of the carriage before from the edge of an image formed upon each scanning, unnecessary scanning of the carriage can be omitted in printless portions, thereby decreasing the print period.

(6) By the arrangement wherein the start position upon each scanning of the carriage is aligned with the position shifted at least the ramp-up distance of the carriage before from the extreme edge of image in each block of consecutive images in the sub-scan direction, the deviation of image dots can be controlled in the low level even with an image of obliquely drawn line or curve.

(7) If the processing of aligning the start positions of carriage in the respective scanning steps is carried out only for printing continuous images in the sub-scan direction, such as ruled lines and graphics, the print period can be decreased by executing the processing only when the processing for aligning the start positions of carriage in the respective scanning steps is necessary.

(8) By the arrangement wherein the cleaning operation of the print head is executed as an operation other than the print operation, in which the carriage is off from the start position of scanning during image print, an excellent image can be formed without degrading the image quality even if cleaning of the print head is carried out midway during the print operation.

Embodiment 3

Embodiment 3 of the present invention will be explained referring to FIG. 14 to FIG. 18. Since the structure of this embodiment 3 is the same as that of embodiment 1 shown in FIG. 1 to FIG. 5, the detailed description thereof is omitted herein.

Figure 14:
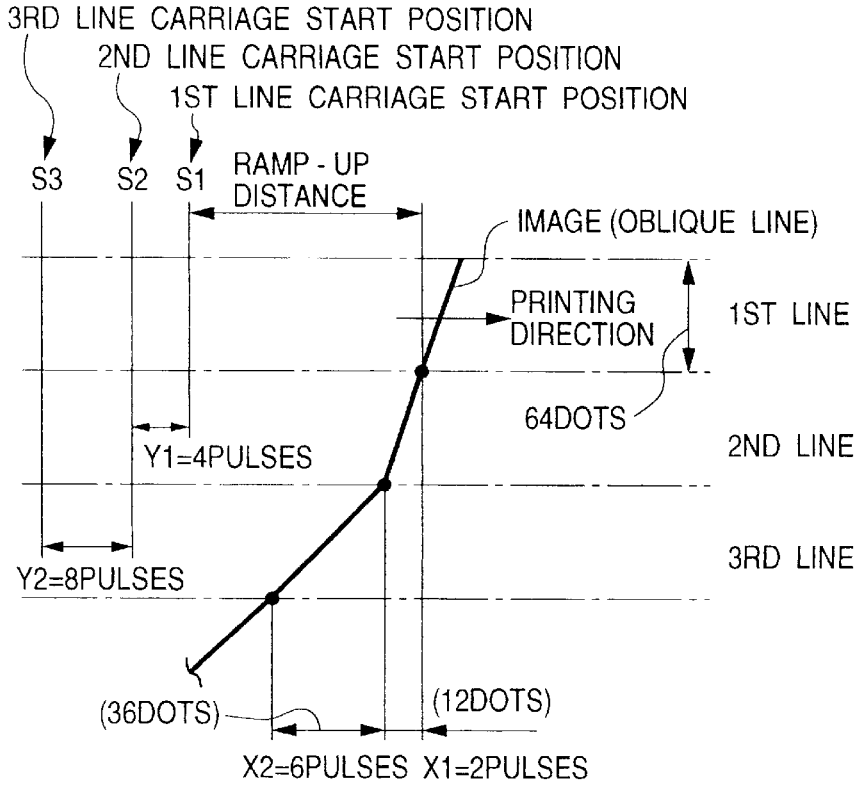
FIG. 14 is an explanatory drawing of drive control of the carriage to show a first example in the third embodiment of the present invention.

The first example of this embodiment 3 is an example in which a monochromatic head of 64 nozzles having the resolution of 360 dpi is used for print in one way from left to right of recording sheet P and in which a leftwardly descending oblique line is printed, as shown in FIG. 14. This corresponds to six dots of image per pulse of motor. Since the drive is the one-two-phase-on drive, four pulses of motor corresponds to one period of motor phase.

The reference is taken at the start position (S1) of carriage for the previous line (the first line) of an image formed by a plurality of consecutive carriage scanning steps in FIG. 14. The carriage start position (S1) is set at the position where the ramp-up distance of 20 to 60 pulses is secured from the printing edge of image. The image formed by the plurality of consecutive carriage scanning steps, stated herein, means not only an image of continuous image dots, but also a sequence of images formed with intervals and by a plurality of carriage scanning steps. A difference of printing end between the first line and the second line, that is, the deviation X1 of starting position of image between them is two pulses. The deviation Y1 of start position of carriage was also two pulses in the conventional apparatus, but the present embodiment is arranged in such a manner that the carriage start position (S2) (for the second line) is set at the position shifted by Y1=4 pulses in order to set the start position at an integral multiple of one period of motor phase.

The next reference is the start position (S2) of the carriage. The inclination of the oblique line changes from the third line, and the deviation X2 of the start position of image becomes six pulses. The deviation Y2 of the carriage start position was also six pulses in the conventional apparatus similarly as above, but the present embodiment is arranged in such a manner that the carriage start position (for the third line) is determined at the position shifted by Y2=8 pulses so as to be set equal to an integral value of one period of motor phase. The start position will be determined in the same manner for the succeeding lines.

By starting printing as arranging the difference of start position upon each scanning for printing of carriage so as to be an integral multiple of one period of phase of motor, a difference of the speed change due to a difference of phase of motor can be suppressed even with occurrence of the speed change of carriage, whereby the deviation of adjacent dots can be controlled in the low level during formation of image upon each scanning, thus forming a high-definition image. Accordingly, this example is free of the increase of cost due to the encoder, the high-resolution motor, or the like. Since the distance in the ramp-up of motor can be made short, the apparatus can be constructed without an increase of the apparatus size.

Further, the reference is defined at the start position of the carriage for the preceding line of the image formed by a plurality of consecutive carriage scanning steps and printing is started so that the difference of start position upon each scanning for printing of carriage from this reference position is arranged to be the distance equal to an integral multiple of one period of phase of motor, whereby positioning of carriage is effected only in necessary portions by simple control, thus realizing high efficiency. Although the foregoing described the case of printing from the left edge of recording sheet P, the same can be applied to the printing case in the opposite direction from the right edge.

The second example of this embodiment 3 is next explained.

Figure 15:
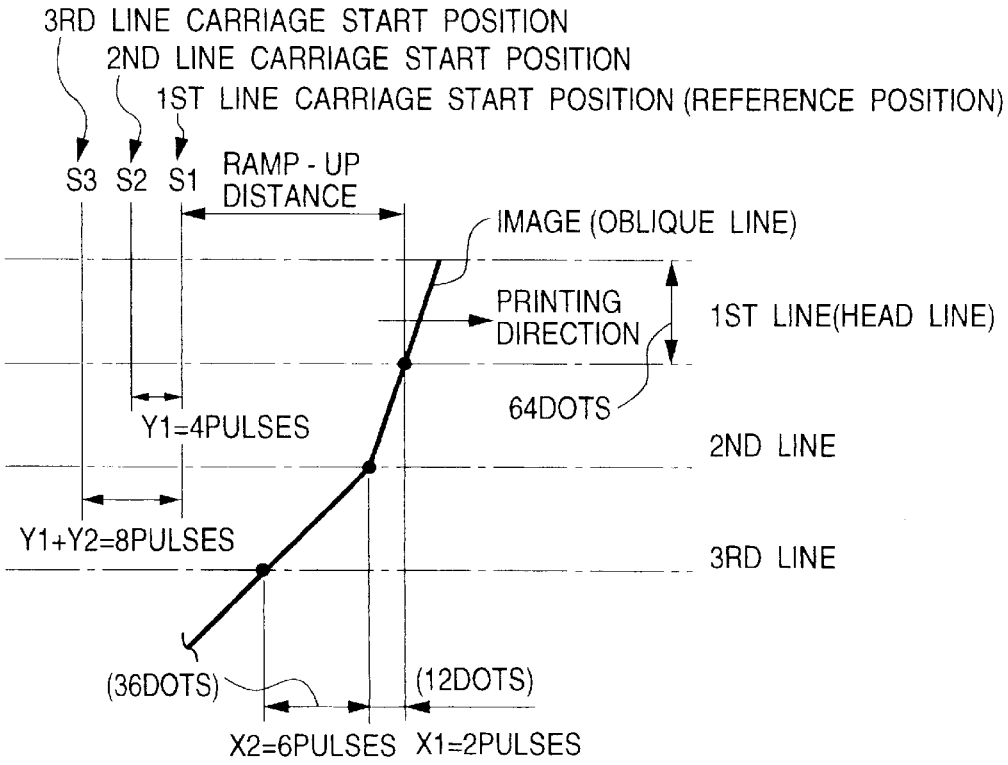
FIG. 15 is an explanatory drawing of drive control of the carriage to show a second example in the third embodiment of the present invention.

The first example of this embodiment 3 was arranged in such a manner that the reference was determined at the start position of carriage for the preceding line of the image formed by the plurality of consecutive carriage scanning steps and that printing was started so that the difference of start position upon each scanning for printing of the carriage from this reference position was arranged to be the distance equal to an integral multiple of one period of phase of motor, and in this case, pulses for correction would come to be accumulated, which could expand the distance of lost scanning. Therefore, the second example is arranged in such a manner that, as shown in FIG. 15, the reference is defined at the start position of the carriage for the head line of the image formed by a plurality of consecutive carriage scanning steps and printing is started so that the difference of start position upon each scanning for printing of the carriage from this reference line is arranged to be the distance equal to an integral multiple of one period of phase of motor.

The reference is determined at the start position (S1) of the carriage for the head line (the first line) of the image formed by the plurality of consecutive carriage scanning steps in FIG. 14. The deviation X1 of start position of image between the first line and the second line is two pulses, but the carriage start position (S2) (for the second line) is set so that the deviation Y1 of carriage start position is four pulses.

The deviation X2 of start position of image for the third line is six pulses. The deviation Y2 of carriage start position was eight pulses in the above first example, whereas the second example is arranged in such a manner that the reference is set at the start position (S1) of carriage for the head line (the first line) and, from X1+X2=8, the carriage start position (S3) for the third line is set 8 pulses apart from the start position (S1) of carriage for the first line and four pulses apart from the carriage start position (S2) for the second line. The start position will be determined in the same manner for the succeeding lines.

This second example is free of unnecessary motion because there is no accumulation of deviation of start position.

The third example of this embodiment 3 is next explained.

Figure 16A:
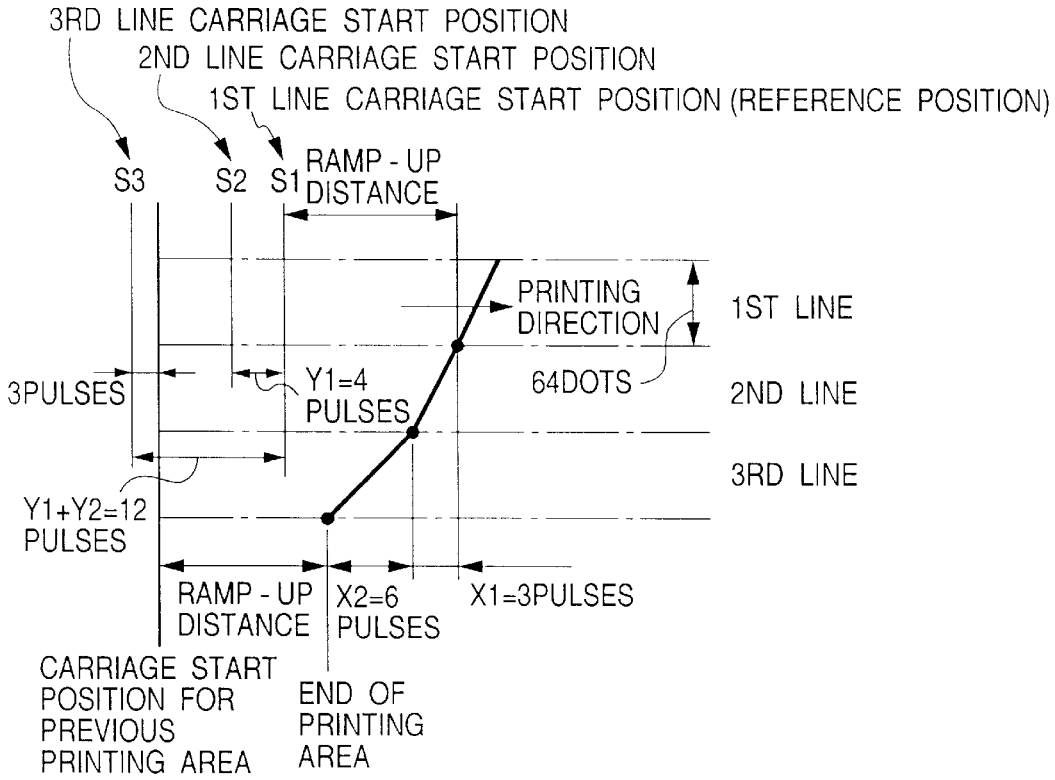
FIG. 16A is an explanatory drawing of drive control of the carriage to show a third example in the third embodiment of the present invention.
Figure 16B:
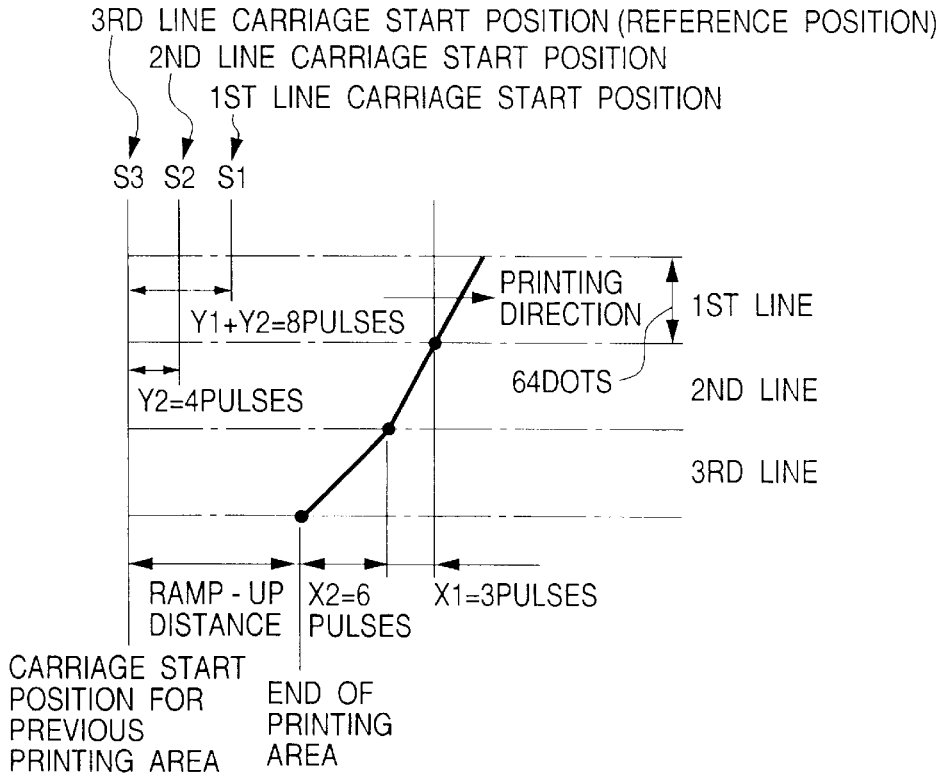
FIG. 16B is an explanatory drawing of drive control of the carriage to show different start positions of the carriage from those of the third example in the third embodiment of the present invention.

The first or second example of this embodiment 3 was arranged in such a manner that the reference was set at the start position of carriage for the preceding line or for the head line of the image formed by the plurality of consecutive carriage scanning steps and printing was started so that the difference of start position upon each scanning for printing of the carriage from this reference position was arranged to be the distance equal to an integral multiple of one period of phase of motor, but the reference may be determined at the start position of the carriage for an image line nearest to the printing edge of the image formed by the plurality of consecutive carriage scanning steps, as shown in FIG. 16B, and printing is started so that the difference of start position upon each scanning for printing of the carriage from this reference position is arranged to be the distance equal to an integral multiple of one period of phase of motor.

If there is an image near the edge of the printing area, as shown in FIG. 16A, there could occur some cases wherein the carriage start position needs to be set outside the carriage start position for the printing edge in the case of the image being a leftwardly and downwardly oblique image or the like as extending up to the printing edge, because the reference position is taken at that for the head line in the case of the second example. The reference was determined at the start position (S1) of carriage for the head line (the first line). The deviation X1 of start position of image between the first line and the second line is three pulses, but the deviation Y1 of the carriage start position was set to four pulses, thus setting the carriage start position (S2) thereat. The deviation X2 of start position of image for the third line is six pulses. From X1+X2=9, the carriage start position (S3) for the third line is located 12 pulses away from the start position (S1) of the carriage for the first line.

However, the third example is arranged in such a manner that, as shown in FIG. 16B, the reference is set at the start position of carriage for the image line closest to the printing edge of the image formed by the plurality of consecutive carriage scanning steps and printing is started so that the difference of start position upon each scanning for printing of the carriage from this reference position is arranged to be the distance equal to an integral multiple of one period of phase of motor, which permits the carriage start position to be set inside on the printing side from the carriage start position for the printing edge in the case of the image extending to the printing edge.

Suppose there is a continuous image across three lines, as shown in FIG. 16B. The third line out of the three lines is the closest to the printing edge of image, and the start position of carriage for the third line is determined to be the reference position (S3). The printing end of the first line is shifted by X1+X2=9 pulses from the third line. Since 9 pulses is not an integral multiple of phase of motor, the start position (S1) of carriage for the first line is located at the position shifted by Y1+Y2=8 pulses from the reference position (S3). The printing end of the second line is shifted by X2=6 pulses from the third line. Since 6 pulses is not an integral multiple of phase of motor, the start position (S2) of carriage for the second line is located at the position shifted by Y2=4 pulses, being an integral multiple of phase of motor, from the reference position (S3).

According to this third example, the carriage start position does not have to be set outside the carriage start position for the printing edge. Further, the efficiency is high because positioning of carriage is carried out only in necessary portions.

The fourth example of this embodiment 3 is next explained.

Figure 17:
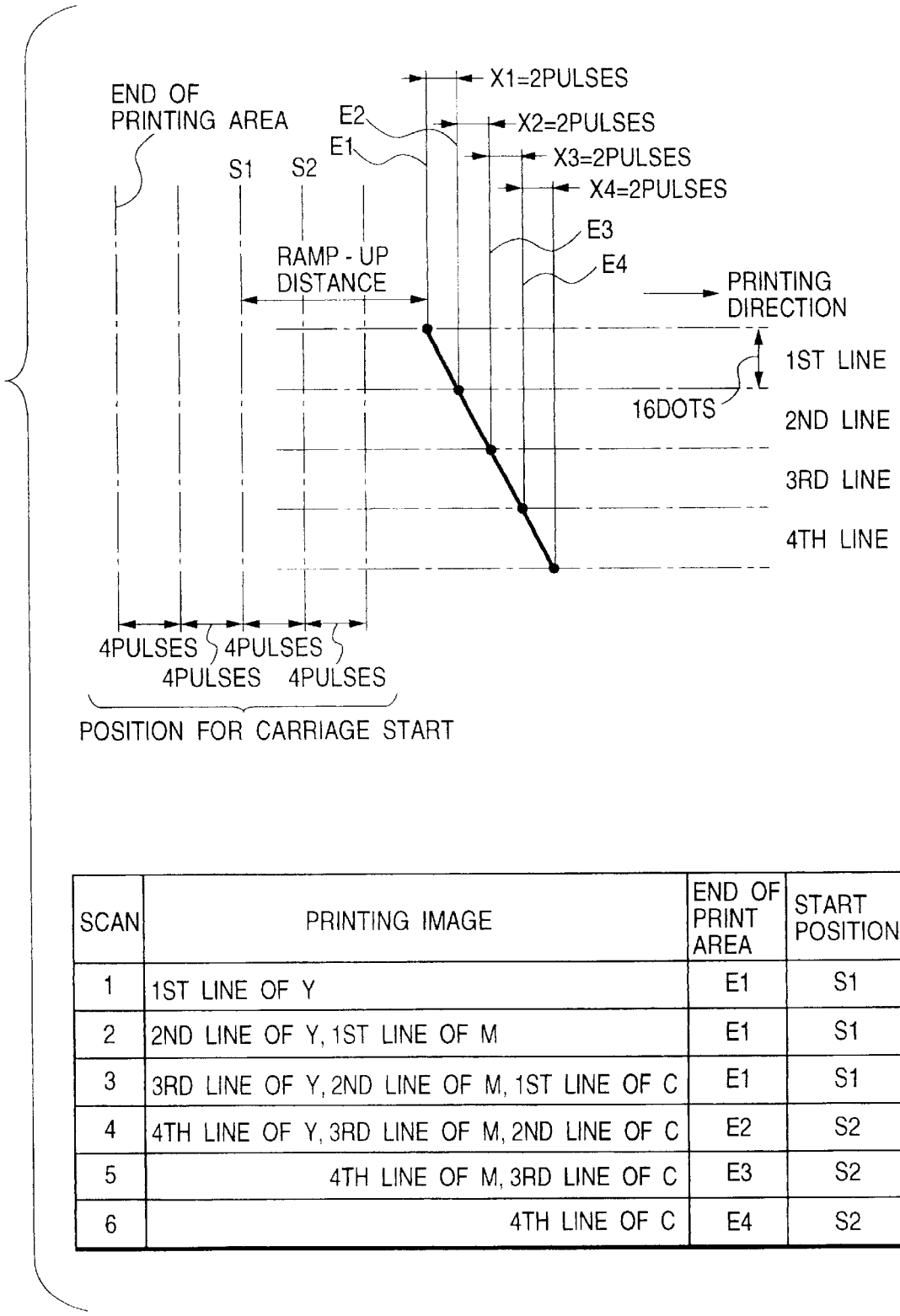
FIG. 17 is an explanatory drawing of drive control of the carriage to show a fourth example in the third embodiment of the present invention.

The third example was arranged in such a manner that the reference was set at the predetermined start position of the carriage and printing was started so that the difference of start position upon each scanning for printing of the carriage from this reference position was arranged to be the distance equal to an integral multiple of one period of phase of motor, but, as shown in FIG. 17, printing may be started so that the start position is determined at a distance equal to an integral multiple of one period of phase of motor away from the start position for the edge of printing area. Explained with this fourth embodiment, as shown in FIG. 17, is an example wherein printing is carried out in one way from left to right of recording sheet P and wherein a black oblique line descending rightwardly and downwardly is formed by a color head of 16 nozzles for each of Y (yellow), M (magenta), and C (cyan), having the resolution of 360 dpi. The nozzles for the three colors of Y, M, and C in the color head are aligned in the direction perpendicular to the scanning direction of carriage. The oblique line is formed as superimposing the three colors of Y, M, and C. One pulse of motor corresponds to six dots of image. Since the drive is the one-two-phase-on drive, four pulses of motor corresponds to one period of motor phase.

As shown in FIG. 17, an image across four lines is formed by six carriage scans. The recording sheet P is carried 16 dots every carriage scan. For the printing area, the carriage start positions are provided at intervals of four pulses or one period of phase of motor from the start position of the edge of printing area. Each scan of carriage effects printing for each color and each line as shown in FIG. 17. For example, the first scan effects printing of only the first line of the color Y. Let us assume that the position the conventional ramp-up distance apart from the print end E1 at this time is S1 coincident just with the carriage start position provided at each interval of four pulses. The second scan prints the second line of the color Y and the first line of the color M. The print end at this time is the position of El and the start position is the same start position S1 as for the first scan. The third scan prints the third line of the color Y, the second line of the color M, and the first line of the color C. The print end at this time is the position of E1, and the carriage start position is the same start position S1 as for the first scan. The fourth scan prints the fourth line of the color Y, the third line of the color M, and the second line of the color C. The printing end at this time is the position of E2, but the carriage start position is the same start position S1 as for the first scan, because the print end is shifted only two pulses right from that in the first to third scans. The fifth scan prints the fourth line of the color M and the third line of the color C. The print end at this time is the position of E3. Since the print end is shifted four pulses right from that in the first to third scans, the carriage start position is also shifted by four pulses so as to be the position of S2. The sixth scan prints the fourth line of the color C. The print end at this time is the position of E4. Since the print end is shifted six pulses right from that in the first to third scans, the carriage start position is shifted four pulses right so as to be the position of S2.

This fourth example can simplify the control by starting printing so that the start position of carriage is aligned with one set at a distance equal to an integral multiple of one period of phase of motor from the start position for the edge of printing area.

The fifth example of this embodiment 3 is next explained.

Figure 18:
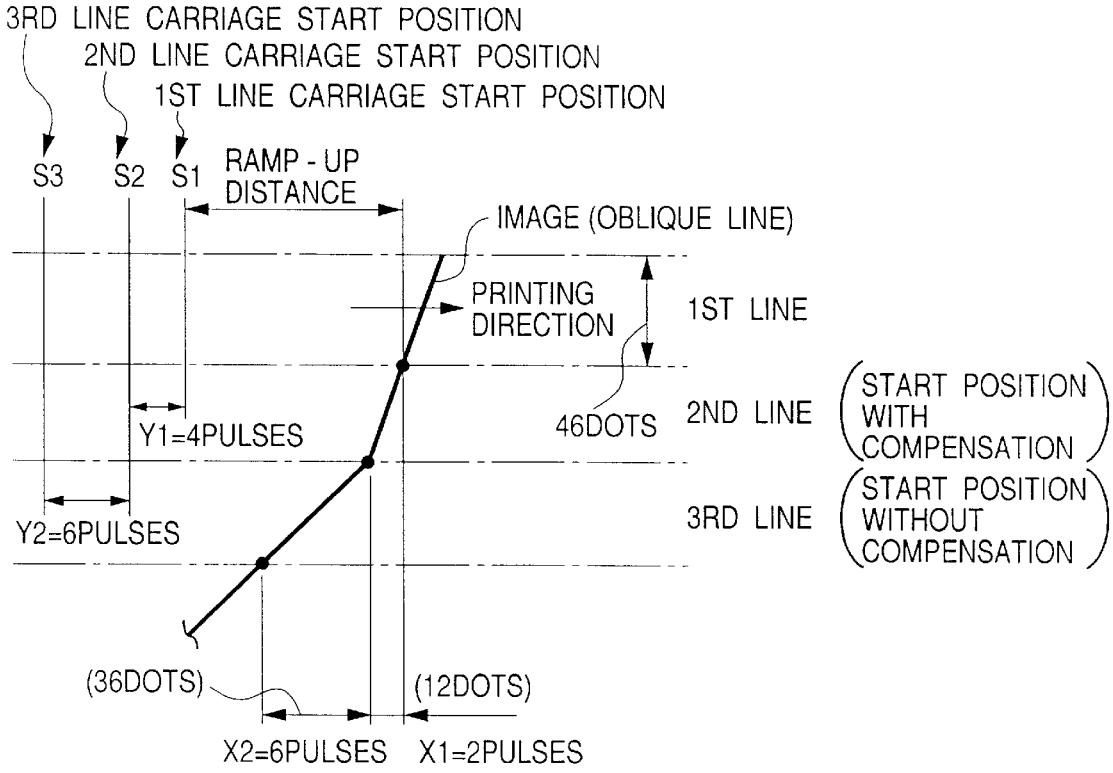
FIG. 18 is an explanatory drawing of drive control of the carriage to show a fifth example in the third embodiment of the present invention.

The fourth example was arranged in such a manner that, for forming the image formed by the plurality of consecutive carriage scanning steps, printing was started so that the difference of start position upon each scanning for printing of carriage was arranged to be the distance equal to an integral multiple of one period of phase of motor, but the start position may be shifted by one period or aligned only if the deviation of image end from the previous line is not more than a predetermined number of pulses, as shown in FIG. 18.

The fifth example is arranged in such a manner that the start position of carriage is corrected only if the deviation of image end from the previous line is not more than one period of phase of motor, that is, not more than four pulses. The reference is set at the start position (S1) of carriage for the previous line (the first line) of the image formed by a plurality of consecutive carriage scanning steps in FIG. 18. The deviation of print end between the first line and the second line, i.e., the deviation X1 of start position of image, is two pulses. The deviation Y1 of the carriage start position was also two pulses in the conventional apparatus, but the fifth example is arranged in such a manner that the carriage start position (S2) (for the second line) is located at the position shifted by Y1=4 pulses so as to be set to an integral multiple of one period of motor phase.

The next reference is the start position (S2) of the carriage. The inclination of the oblique line changes from the third line, and the deviation X2 of start position of image becomes 6 pulses. Since the deviation is greater than four pulses being one period of phase of motor, the start position of the carriage is not corrected at this time and the deviation Y2 of the carriage start position is six pulses, equal to the deviation of the start position of the image. The fifth example is arranged in such a manner that the start position of the carriage is corrected only if the deviation of image end from the previous line is not more than one period of phase of motor, i.e., not more than four pulses, but the number of pulses may be determined to be any other number.

According to the fifth example, because the printing accuracy greatly deviates immediately after ramp-up of scanning of carriage, the effect can be great on the printing deviation also by the arrangement wherein the start position of printing of carriage is shifted by one period or aligned only if the difference of start position upon each scanning for printing of the carriage is not more than the predetermined number of pulses of the motor, thus simplifying the control more.

As detailed above, Embodiment 3 enjoys the following advantages.

(1) By the arrangement wherein printing is started so that the difference of start position upon each scanning for printing of carriage is arranged to be the distance equal to an integral multiple of one period of phase of motor, the difference of speed change due to the difference of phase of motor can be suppressed even with occurrence of speed change of the carriage, whereby the deviation of adjacent dots can be controlled in the low level during formation of image upon each scanning, thus enabling to form a high-definition image. Accordingly, the present embodiment is free of the increase of cost due to the encoder, the high-resolution motor, or the like. The embodiment is also free of the increase of apparatus size, because the distance upon ramp-up of motor can be set short.

(2) By the arrangement wherein the reference is set at the start position of the carriage for the previous line of the image formed by the plurality of consecutive carriage scanning steps and printing is started so that the difference of start position upon each scanning for printing of the carriage from this reference position is arranged to be the distance equal to an integral multiple of one period of phase of motor, positioning of the carriage is carried out only in necessary portions by the simple control, thus achieving high efficiency.

(3) By the arrangement wherein the reference is set at the start position of the carriage for the head line of the image formed by the plurality of consecutive carriage scanning steps and printing is started so that the difference of start position upon each scanning for printing of the carriage from this reference position is arranged to be the distance equal to an integral multiple of one period of phase of motor, positioning of the carriage is carried out only in necessary portions by the simple control, thus achieving high efficiency. Since there is no accumulation of deviation of start position, the arrangement is free of unnecessary motion.

(4) By the arrangement wherein the reference is set at the start position of the carriage for the image line closest to the print end of the image formed by the plurality of consecutive carriage scanning steps and printing is started so that the difference of start position upon each scanning for printing of the carriage from this reference position is arranged to be the distance equal to an integral multiple of one period of phase of motor, the carriage start position does not have to be set outside of the carriage start position for the printing edge. Further, the high efficiency can be achieved, because the positioning of the carriage is carried out only in necessary portions.

(5) By starting printing so that the start position of the carriage is aligned with the start position set at the distance of an integral multiple of one period of phase of motor from the start position for the edge of the printing area, the control can be simplified.

(6) By the arrangement wherein the print start position of the carriage is shifted by one period or aligned only if the difference of start position upon each scanning for printing of the carriage is not more than the predetermined number of pulses of motor, the effect can be achieved by simple control.

Embodiment 4

Embodiment 4 of the present invention will be explained referring to FIGS. 19A, 19B to FIGS. 22A, 22B. Since the structure of this embodiment 4 is the same as that of foregoing embodiment 1 shown in FIG. 1 to FIG. 4, the detailed description thereof is omitted herein.

Figure 20:
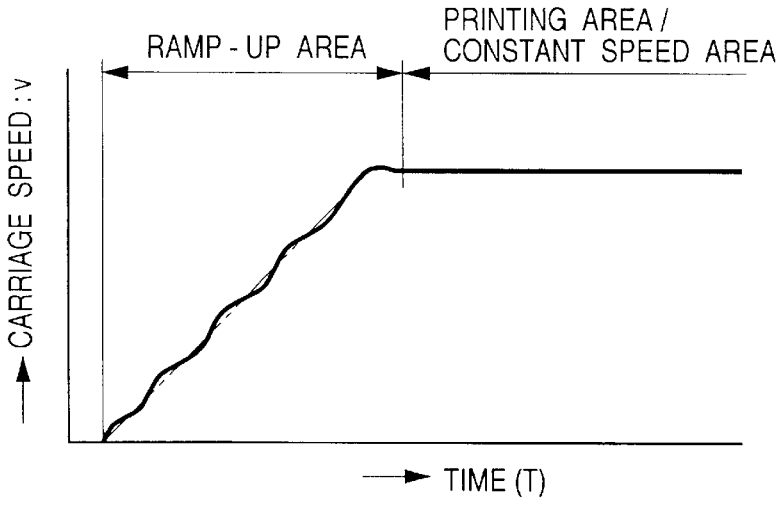
FIG. 20 is an explanatory drawing of velocity change of the carriage in the first example in the fourth embodiment of the present invention.
Figure 19A:
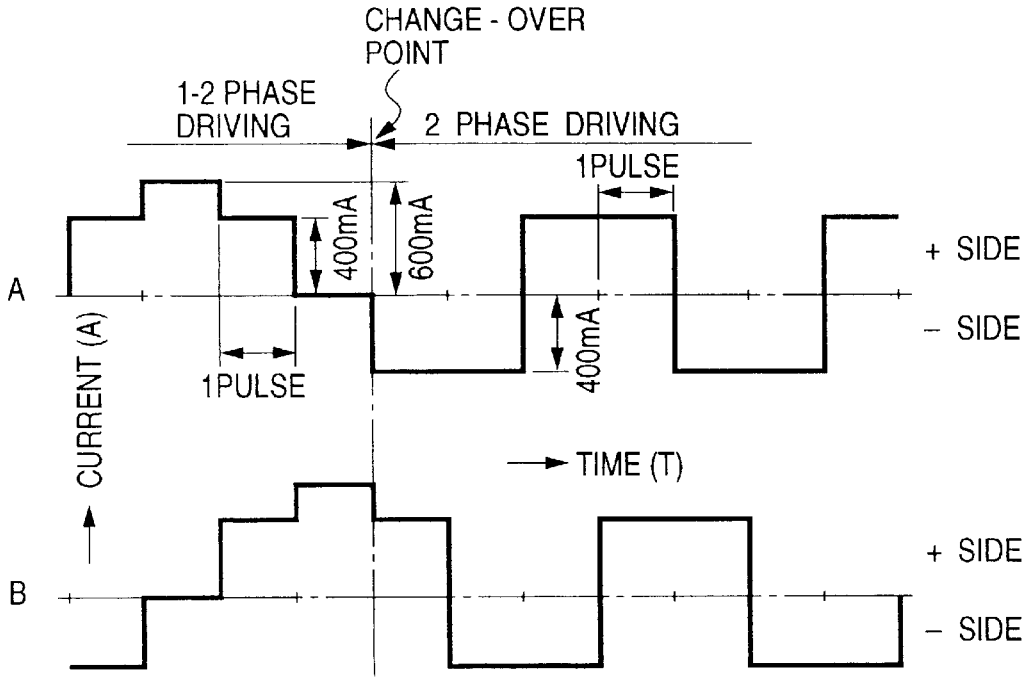
FIG. 19A is a current waveform diagram of a carriage driving motor, showing a first example in the fourth embodiment of the present invention.
Figure 19B:
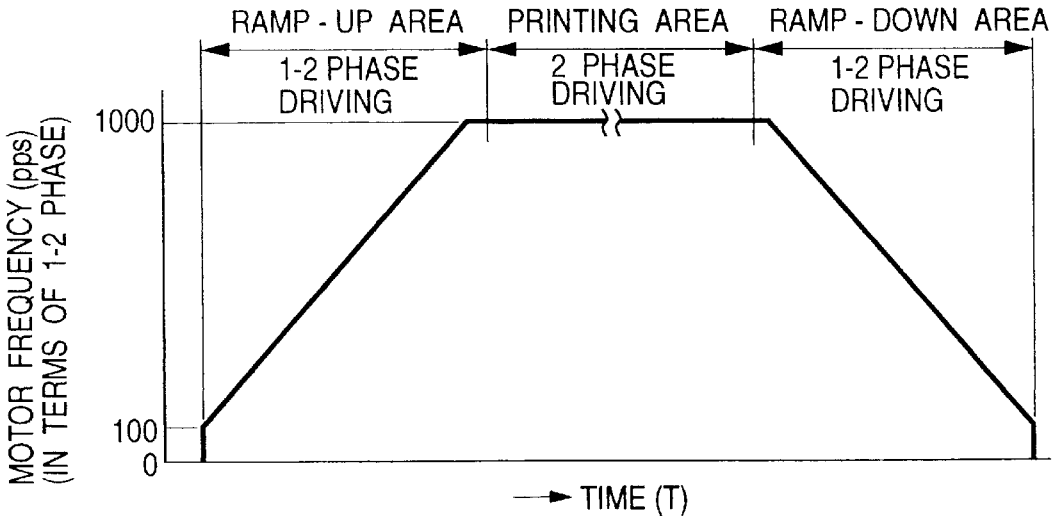
FIG. 19B is a drive characteristic diagram of the carriage in the first example in the fourth embodiment of the present invention.

The first example of this embodiment 4 uses the one-two-phase-on drive for the ramp-up region of motor and the two-phase-on drive for the constant-speed region being the printing range, as shown in FIGS. 19A and 19B. Electric currents as shown in FIG. 19A are supplied to the CR motor 80, and the CR motor driver 105 in this case performs such control as to form rectangular current waveforms, similar to those in the foregoing. In the case of the one-two-phase-on drive, the electric current is, for example, 600 mA upon excitation of one phase or 400 mA (per phase) upon excitation of two phases so as to equalize the torque upon excitation of one phase with that upon excitation of two phases. In the case of the two-phase-on drive after changeover, the current of 400 mA (per phase) is supplied upon excitation of two phases. FIG. 19B shows an example of the changeover of the motor drive, which shows that the current waveforms can be connected well at changeover anywhere. Since the ramp-down includes low-speed rotation, the drive is changed over again into the one-two-phase-on drive. The above arrangement realizes a rise with less vibration and without having large speed change in the low-speed region during ramp-up, as shown in FIG. 20

The speed change of one period (4 pulses) of motor phase is also controlled in the low level in the constant-speed range of the printing area. The present embodiment employs the stepping motor as the CR motor 80 for driving the carriage and the stepping motor is driven based on the drive method of phases for switching excitation of the stepping motor in the sequential operation including the ramp-up and ramp-down to move the carriage for printing, arranged to drive the stepping motor as switching at least two out of the single-phase full-step drive method for exciting the motor in single phase, the full-phase full-step drive method for exciting the motor in full phases, and the half-step drive method for exciting the motor in a predetermined number of phases. This can control the change of rotation speed of motor in the low level so as to achieve smooth motion even in the structure of the low-resolution stepping motor of simple control or the like without using an encoder, whereby an improvement in the print quality can be realized as suppressing the print unevenness or the like.

Therefore, even the low-cost motor and motor driver can realize the functions equivalent to those in the conventional apparatus. Further, restrictions on the motor and motor driver are decreased, which increases degrees of freedom for design, manufacturing, and so on.

The second example of this embodiment 4 is next explained.

Figure 21A:
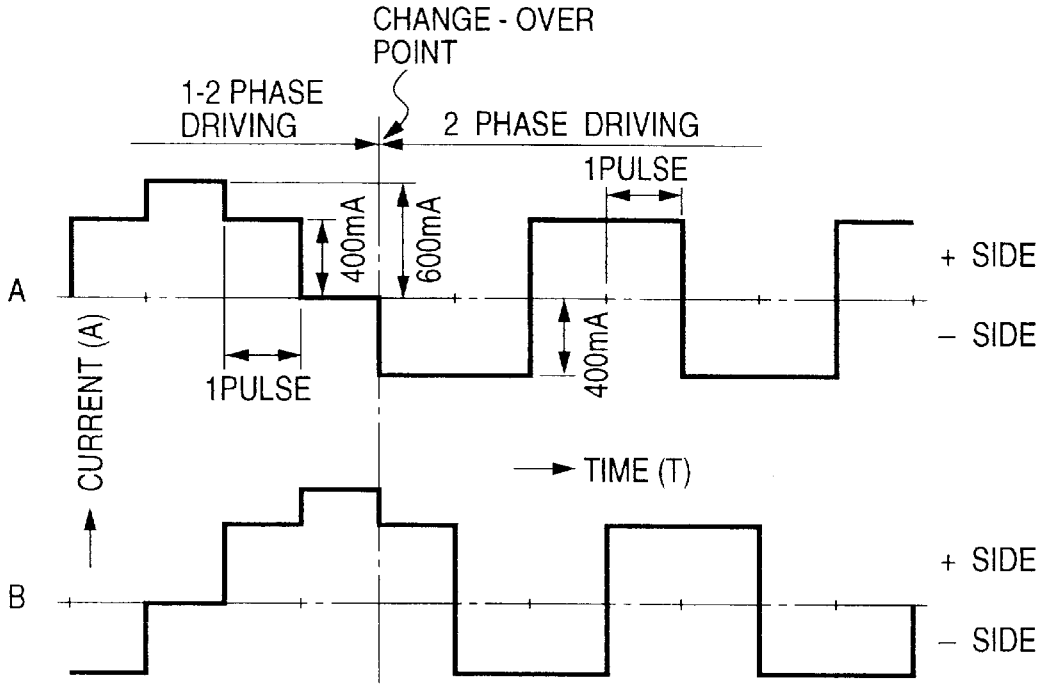
FIG. 21A is a current waveform diagram of the carriage driving motor, showing a second example in the fourth embodiment of the present invention.
Figure 21B:
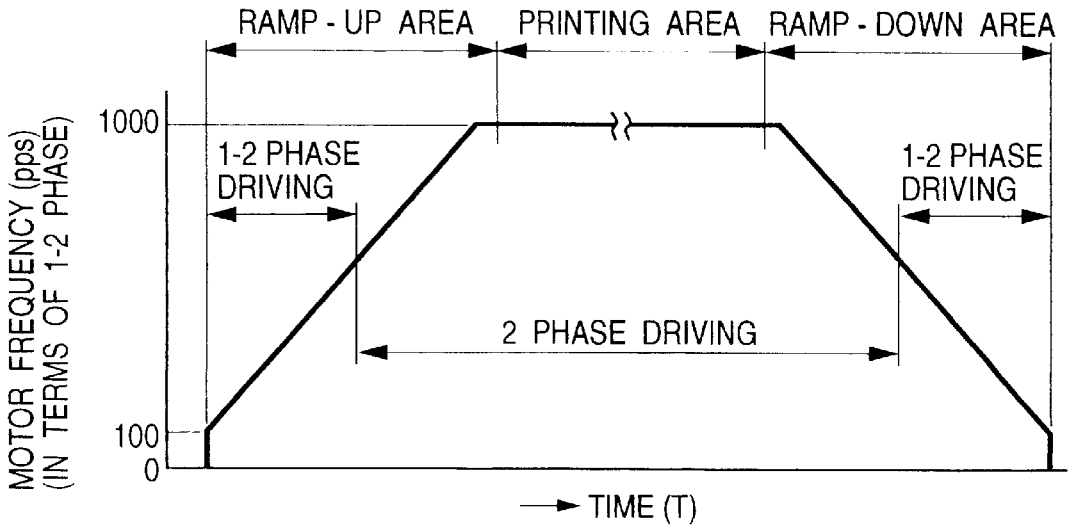
FIG. 21B is a drive characteristic diagram of the carriage in the second example in the fourth embodiment of the present invention.

The first example was arranged in such a manner that the one-two-phase-on half-step drive was employed for the ramp-up and ramp-down of the stepping motor in the printing operation of the carriage and the single-phase or two-phase full-step drive for the constant-speed range during printing, and vibration sometimes occurred during printing with switching of the drive near the printing area. Therefore, the drive may be arranged in such a manner that the one-two-phase half-step drive is used up to the midway of the ramp-up of the stepping motor in the printing operation of the carriage and the two-phase full-step drive for the subsequent ramp-up and the constant-speed range during printing, as shown in FIGS. 21A and 21B. Also, the drive may be arranged so that the two-phase full-step drive is employed up to the midway of the ramp-down and the one-two-phase half-step drive for the subsequent ramp-down.

In the second example, as shown in FIGS. 21A and 21B, the drive is switched from the one-two-phase-on drive to the two-phase-on drive on the way of ramp-up and the two-phase-on drive is used in the constant-speed region being the printing range. The currents as shown in FIG. 21A are supplied to the CR motor 80. The CR motor driver 105 in this case also performs such control as to form the rectangular current waveforms, similar to those in the foregoing. In the case of the one-two-phase-on drive, the current is, for example, 600 mA for excitation of one phase or 400 mA (per phase) for excitation of two phases so as to equalize the torque upon excitation of one phase with that upon excitation of two phases. In the case of the two-phase-on drive after changeover, the current of 400 mA (per phase) is supplied upon excitation of two phases. The drawing illustrates an example of the changeover of the motor drive, but the current waveforms can be connected well even with switching anywhere.

During the ramp-up, as shown in FIG. 21B, the drive is switched at about 700 pps and after 10 pulses from the one-two-phase-on drive to the two-phase-on drive. As in this example, it is desirable to switch the drive at a point over the low-speed range, i.e., at a point where after switching of the drive from the one-two-phase-on drive to the two-phase-on drive there is the time and distance enough to absorb influence thereof. Namely, an appropriate point is selected from the range having one sixth to the half of the total ramp-up pulse number and the quarter to two thirds of the constant-speed frequency. Switching here from the one-two-phase-on drive to the one-phase-on drive can be smooth switching, thus realizing the drive with less speed change.

Also in the ramp-down, as shown in FIG. 21B, the drive is switched from the two-phase-on drive to the one-two-phase-on drive at about 700 pps and at the point of remaining 10 pulses for ramp-down, in symmetry with the ramp-up. Since the switching in this case is irrespective of printing, there is no big difference even if it is effected at the start of the ramp-down, similarly as in the first example. The second example can realize smooth rotation depending upon the rotation frequency of motor and includes less influence of switching of drive in the printing area.

The third example of this embodiment 4 is next explained.

Figure 22A:
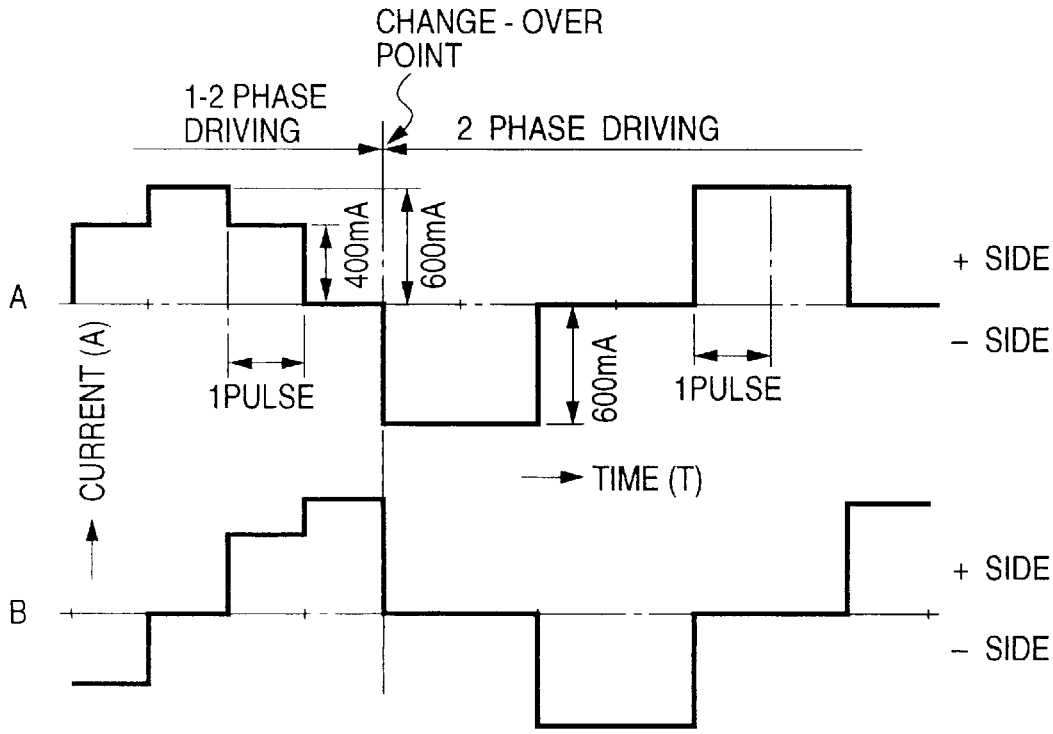
FIG. 22A is a current waveform diagram of the carriage driving motor, showing a third example in the fourth embodiment of the present invention.
Figure 22B:
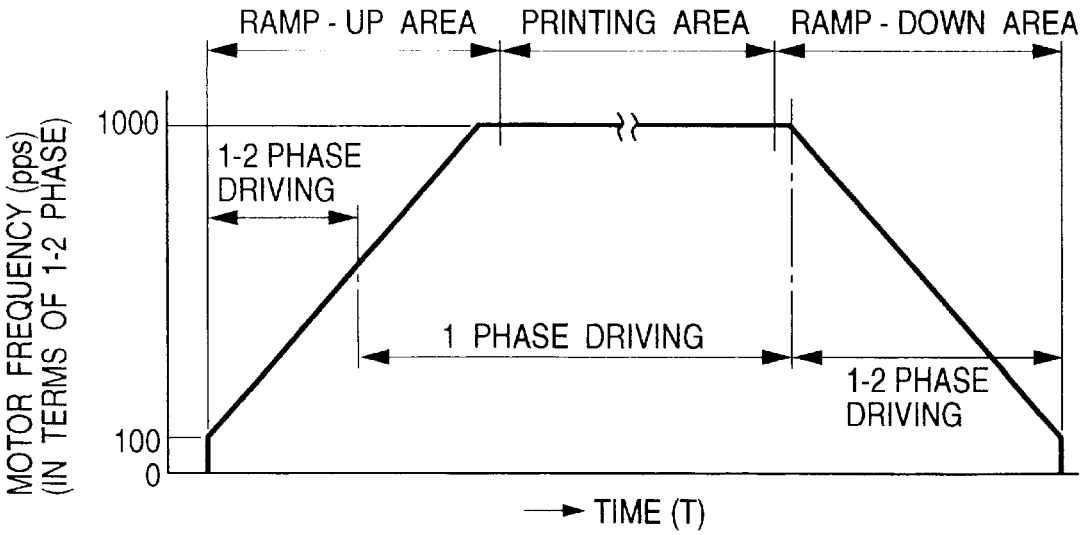
FIG. 22B is a drive characteristic diagram of the carriage in the third example in the fourth embodiment of the present invention.

The first and second examples were arranged in such a manner that switching between the one-two-phase half-step drive and the two-phase full-step drive was carried out in the drive of phase to switch excitation of the stepping motor in the sequential operation including the ramp-up and ramp-down to move the carriage for printing, but switching may be effected between the one-two-phase half-step drive and the one-phase full-step drive, as shown in FIGS. 22A and 22B. The third example, as shown in FIGS. 22A and 22B, is arranged to switch the drive midway of the ramp-up from the one-two-phase-on drive to the one-phase-on drive and to use the one-phase-on drive for the constant-speed region being the printing range. The currents as shown in FIG. 22A are supplied to the CR motor 80. The CR motor driver 105 in this case also performs such control as to form the rectangular current waveforms, similar to those in the foregoing. In the case of the one-two-phase-on drive, the current is, for example, 600 mA for excitation of one phase or 400 mA (per phase) for excitation of two phases so as to equalize the torque upon excitation of one phase with that upon excitation of two phases. In the case of the one-phase-on drive after switching, the current of 600 mA (per phase) upon excitation of one phase is supplied. The drawing shows an example of the switching of the motor drive, but the current waveforms can be connected well even with switching anywhere.

During the ramp-up, as shown in FIG. 22B, the drive is switched at about 700 pps and after 10 pulses from the one-two-phase-on drive to the one-phase-on drive. As in this example, it is desired to switch the drive at a point over the low-speed range, i.e., at a point where after switching of the drive from the one-two-phase-on drive to the one-phase-on drive there is the time and distance enough to absorb the influence thereof. Namely, an appropriate point may be selected from the range having one sixth to the half of the total ramp-up pulse number and the quarter to two thirds of the constant-speed frequency. Switching here from the one-two-phase-on drive to the one-phase-on drive can be smooth switching, thus realizing the drive with less speed change.

Since the ramp-down includes the low-speed rotation, the drive is again switched to the one-two-phase-on drive. Since the switching in this case is irrespective of printing, the switching is effected at the start of ramp-down in the same manner as in the first example. However, the drive can be switched midway of the ramp-down, similar to the ramp-up, as in the foregoing second example. According to the third example, the rotation torque is decreased as compared with that in the two-phase-on drive, but the one-phase-on drive is effective to easily achieve high angular stop position accuracy, whereby accurate rotation can be realized in some cases.

Embodiment 4 enjoys the following advantages.

(1) By the arrangement wherein the stepping motor for driving the carriage is used and the stepping motor is driven by the drive of phase to switch excitation of the stepping motor in the sequential operation including the ramp-up and ramp-down to move the carriage for printing, as switching at least two of the single-phase full-step drive method for exciting the motor in single phase, the full-phase full-step drive method for exciting the motor in full phases, and the half-step drive method for exciting the motor in a predetermined number of phases, the rotation speed change of motor can be controlled in the low level even by the structure of the low-resolution stepping motor of simple control or the like without using an encoder, so as to achieve smooth motion and avoid printing unevenness, thus realizing an improvement in the print quality. Accordingly, the low-cost motor and motor driver can realize the functions equivalent to those in the conventional apparatus. Further, the restrictions on the motor and motor driver are decreased, which increases degrees of freedom for design, manufacturing, and so on.

(2) By the arrangement wherein the half-step drive is used for ramp-up and ramp-down of the stepping motor during the printing operation of carriage and the single-phase or full-phase full-step drive for the constant-speed region during printing, smooth rotation can be realized depending upon the rotation frequency of motor.

(3) By the arrangement wherein in the printing operation of carriage the half step drive is used for the low-speed region of ramp-up of the stepping motor, the single-phase or full-phase full-step drive for the high-speed region of ramp-up and for the constant-speed region during printing, and the half step drive for the ramp-down, or the half step drive for the low-speed region of ramp-down and the full-phase full-step drive for the high-speed region of ramp-down, smooth rotation can be realized depending upon the rotation frequency of motor. Further, the influence of switching of drive rarely appears in the printing area.

(4) By the arrangement wherein the switching from the half step drive to the single-phase or full-phase full-step drive during the ramp-up of the stepping motor is effected at one fifth to the half of the ramp-up distance, smooth rotation can be realized more according to the rotation frequency of motor.

(5) By the arrangement wherein the switching from the half-step drive to the single-phase or full-phase full-step drive during the ramp-up of the stepping motor is effected at the quarter to two thirds of the constant-speed frequency during printing, smooth rotation can be realized more according to the rotation frequency of motor.

What is claimed is:

1. A recording apparatus comprising:

a recording head for forming an image on a recording medium;

a carriage for holding said recording head, capable of scanning in a main scanning direction, said carriage being scanned for a recording operation and for an operation other than said recording operation, said carriage beginning scanning during the recording operation from a first predetermined start position and beginning movement after scanning for the operation other than the recording operation from a second predetermined start position, the first predetermined start position being different from the second predetermined start position;

carrying means for carrying said recording medium in a sub-scanning direction; and control means for controlling said carriage so that said carriage begins scanning from the fist predetermined start position each time of continuous scanning, and when an initial position of said carriage is the second predetermined start position, said control means controls movement of said carriage to the first predetermined start position and stopping said carriage thereat before beginning the scanning of said carriage.

2. The recording apparatus according to claim 1, wherein during the recording operation said control means aligns the first predetermined start position upon each scanning of said carriage with a position shifted at least a ramp-up distance of said carriage away from an edge of a recording area of said recording medium.

3. The recording apparatus according to claim 1, wherein during the recording operation said control means aligns the first predetermined start position upon each scanning of said carriage with a position shifted at least a ramp-up distance of said carriage away from an edge of an image formed upon each scanning.

4. The recording apparatus according to claim 1, wherein during an operation other than said recording operation said control means aligns the second predetermined start position upon each scanning of said carriage with a position shifted at least a ramp-up distance of said carriage away from an extreme end of an image in each block of images consecutive at least in the sub-scanning direction.

5. The recording apparatus according to claim 4, wherein said controlling means functions in the case of forming images consecutive in the sub-scanning direction.

6. The recording apparatus according to claim 1, wherein said controlling means performs a control operation when the position of said carriage is shifted before scanning of the carriage in order to perform a cleaning operation of said recording head other than a recording operation.

7. The recording apparatus according to claim 1, wherein said recording head is an ink jet recording head for ejecting ink, utilizing thermal energy.

8. A recording apparatus comprising:

a recording head for forming an image on a recording medium;

a carriage for holding said recording head, capable of scanning in a main scanning direction, said carriage being scanned for a recording operation and for an operation other than the recording operation, said carriage beginning scanning during the recording operation from a first predetermined start position and beginning moving after scanning for the operation other than the recording operation from a second predetermined start position, the first predetermined start position being different from the second predetermined start position;

carrying means for carrying said recording medium in a sub-scanning direction; and control means for controlling said carriage so that said carriage begins scanning from the first predetermined start position each time of continuous scanning, and when an initial position of said carriage is the second predetermined start position, said control means controls movement of said carriage to a position beyond the first predetermined start position and returns said carriage to the first predetermined start position and stopping said carriage thereat before beginning the scanning of said carriage.

9. The recording apparatus according to claim 8, wherein said controlling means makes a moving speed in returning said carriage from said position to said predetermined start positions of scanning substantially equal to a moving speed in returning said carriage to said predetermined start positions of scanning during normal recording scanning.

10. The recording apparatus according to claim 8, wherein said controlling means makes a distance between said second predetermined start position and said position substantially equal to a sum of a ramp-up distance and a ramp-down distance of said carriage.

* * * * *

UNITED STATES PATENT AND TRADEMARK OFFICE

CERTIFICATE OF CORRECTION

PATENT NO. : 6,152,626
DATED : November 28, 2000
INVENTOR(S) : Haruyuki Yanagi, et al.

It is certified that error appears in the above-identified patent and that said Letters Patent is hereby corrected as shown below:

Column 3,
Line 66, lof" should read -- 1 of --.

Column 7,
Lines 12 and 45, "at" should read -- as --; and
Lines 13 and 38, "before" should be deleted.

Column 8,
Lines 3 and 60, "before" should read -- from --; and
Line 58, "at" should read -- as --.

Column 9,
Lines 37 and 46, "before" should be deleted; and
Line 45, "at" should read -- as --.

Column 10,
Line 24, "before" should read -- from --.

Column 11,
Lines 32 and 39, "of carriage" should read -- of the carriage --;
Lines 38, 43 and 49, "before" should be deleted; and
Lines 55 and 59, "carriage" should read -- the carriage --.

Column 12,
Lines 15, 46, 50, 62 and 65, "carriage" should read -- the carriage --; and
Line 55, "motor" should read -- the motor --.

Column 13,
Lines 7, 37 and 48, "carriage" should read -- the carriage --.

Column 14,
Lines 3, 14, 27, 31, 35 and 42 , "carriage" should read -- the carriage --.
Line 65, "carriage." should read -- the carriage. --.

Column 15,
Line 8, "printing area" should read -- the printing area --; and "carriage" should read -- the carriage --;
Line 10, "position" should read -- position of --;
Lines 37, 46, 54 and 57, "carriage" should read -- the carriage --; and
Line 40, "printing" should read -- the printing --.

UNITED STATES PATENT AND TRADEMARK OFFICE

CERTIFICATE OF CORRECTION

PATENT NO. : 6,152,626
DATED : November 28, 2000
INVENTOR(S) : Haruyuki Yanagi, et al.

It is certified that error appears in the above-identified patent and that said Letters Patent is hereby corrected as shown below:

Column 16,
Lines 16, 18 and 27, "carriage" should read -- the carriage --.

Column 17,
Lines 25 and 59, "motor" should read -- the motor --.

Column 18,
Line 47, "there is the" should read -- there is --; and "absorb" should read -- absorb the --.

Column 19,
Line 30, "the time" should read -- time --.

Column 20,
Lines 19, 26 and 32, "motor." should read -- the motor. --; and
Line 52, "fist" should read -- first--.

Signed and Sealed this

Twenty-seventh day of November, 2001

*Attest:*

Nicholas P. Godici

*Attesting Officer*

NICHOLAS P. GODICI
*Acting Director of the United States Patent and Trademark Office*

UNITED STATES PATENT AND TRADEMARK OFFICE

CERTIFICATE OF CORRECTION

PATENT NO. : 6,152,626
DATED : November 28, 2000
INVENTOR(S) : Haruyuki Yanagi et al.

It is certified that error appears in the above-identified patent and that said Letters Patent is hereby corrected as shown below:

Column 3,
Line 66, "lof" should read -- 1 of --.

Column 7,
Line 12, "at" should read -- as --;
Line 13, "before" should be deleted;
Line 38, "before" should be deleted; and
Line 45, "at" should read -- as --.

Column 8,
Line 3, "before" should read -- from --;
Line 58, "at" should read -- as --; and
Line 60, "before" should read -- from --.

Column 9,
Line 37, "before" should be deleted;
Line 45, "at" should read -- as --;
Line 46, "before" should be deleted.

Column 10,
Line 24, "before" should read -- from --.

Column 11,
Line 32, "of carriage" should read -- of the carriage --;
Line 38, "before" should be deleted;
Line 39, "of carriage" should read -- of the carriage --;
Line 43, "before" should be deleted;
Line 49, "before" should be deleted;
Line 55, "carriage" should read -- the carriage --; and
Line 59, "carriage" should read -- the carriage --.

UNITED STATES PATENT AND TRADEMARK OFFICE

CERTIFICATE OF CORRECTION

PATENT NO. : 6,152,626
DATED : November 28, 2000
INVENTOR(S) : Haruyuki Yanagi et al.

It is certified that error appears in the above-identified patent and that said Letters Patent is hereby corrected as shown below:

Column 12,
Line 15, "carriage" should read -- the carriage --;
Line 46, "carriage" should read -- the carriage --;
Line 50, "carriage," should read -- the carriage, --;
Line 55, "motor" should read -- the motor --;
Line 62, "carriage" should read -- the carriage --; and
Line 65, "carriage" should read -- the carraige --.

Column 13,
Line 7, "carriage" should read -- the carriage --;
Line 37, "carriage" should read -- the carriage --; and
Line 48, "carriage" should read -- the carriage --.

Column 14,
Line 3, "carriage" should read -- the carriage --;
Line 14, "carriage" should read -- the carriage --;
Line 27, "carriage" should read -- the carriage --;
Line 31, "carriage" should read -- the carriage --;
Line 35, "carriage" should read -- the carriage --;
Line 42, "carriage" should read -- the carriage --; and
Line 65, "carriage." should read -- the carriage. --.

Column 15,
Line 8, "printing area" should read -- the printing area --; and
"carriage" should read -- the carriage --;
Line 10, "position" should read --position of --;
Line 37, "carriage" should read -- the carriage --;
Line 40, "printing" should read -- the printing --;
Line 46, "carriage" should read -- the carriage --;
Line 54, "carriage" should read -- the carriage --; and
Line 57, "carriage" should read -- the carriage --.

Column 16,
Line 16, "carriage" should read -- the carriage --;
Line 18, "carriage" should read -- the carriage --; and
Line 27, "carriage" should read -- the carriage --.

UNITED STATES PATENT AND TRADEMARK OFFICE

CERTIFICATE OF CORRECTION

PATENT NO. : 6,152,626
DATED : November 28, 2000
INVENTOR(S) : Haruyuki Yanagi et al.

It is certified that error appears in the above-identified patent and that said Letters Patent is hereby corrected as shown below:

Column 17,
Line 25, "motor" should read -- the motor --; and
Line 59, "motor" should read -- the motor --.

Column 18,
Line 47, "there is the" should read -- there is --; and
"absorb" should read -- absorb the --.

Column 19,
Line 30, "the time" should read -- time --.

Column 20,
Line 19, "motor." should read -- the motor. --;
Line 26, "motor." should read -- the motor. --;
Line 32, "motor." should read -- the motor. --; and
Line 52, "fist" should read -- first --.

Signed and Sealed this

Eleventh Day of December, 2001

*Attest:*

Nicholas P. Godici

NICHOLAS P. GODICI
*Acting Director of the United States Patent and Trademark Office*

*Attesting Officer*